US011278171B2

(12) United States Patent
Carter et al.

(10) Patent No.: US 11,278,171 B2
(45) Date of Patent: Mar. 22, 2022

(54) SURFACE CLEANING HEAD WITH DUAL ROTATING AGITATORS

(71) Applicant: SHARKNINJA OPERATING LLC, Newton, MA (US)

(72) Inventors: Steven Paul Carter, London (GB); Adam Udy, Sutton (GB); Catriona A. Sutter, London (GB); Christopher Pinches, Surrey (GB); David S. Clare, London (GB); Andre David Brown, Natick, MA (US); John Freese, Newton, MA (US); Patrick Cleary, Allston, MA (US); Alexander Calvino, Newton, MA (US); Lee Cottrell, Newton, MA (US); Daniel Meyer, Boston, MA (US); Daniel John Innes, West Roxbury, MA (US); David Jalbert, Newtown, MA (US); Jason Thorne, Wellesley Hills, MA (US); Peter Hutchinson, Suzhou (CN); Gordon Howes, Newton, MA (US); Nancy Gao Wenxiu, Suzhou (CN); David Wu, Newton, MA (US); David W. Poirier, Lexington, MA (US)

(73) Assignee: SharkNinja Operating LLC, Needham, MA (US)

( * ) Notice: Subject to any disclaimer, the term of this patent is extended or adjusted under 35 U.S.C. 154(b) by 200 days.

(21) Appl. No.: 15/331,045

(22) Filed: Oct. 21, 2016

(65) Prior Publication Data

US 2017/0127896 A1 May 11, 2017

Related U.S. Application Data

(60) Provisional application No. 62/244,331, filed on Oct. 21, 2015, provisional application No. 62/248,813, (Continued)

(51) Int. Cl.
*A47L 9/04* (2006.01)
*A47L 5/26* (2006.01)

(Continued)

(52) U.S. Cl.
CPC ..... *A47L 9/0488* (2013.01); *A47L 5/26* (2013.01); *A47L 5/30* (2013.01); *A47L 9/0405* (2013.01);

(Continued)

(58) Field of Classification Search
CPC ..... A47L 5/30; A47L 9/0488; A47L 9/0477

(Continued)

(56) References Cited

U.S. PATENT DOCUMENTS 2,032,345 A 3/1936 Cranon
2,411,488 A 11/1946 White (Continued)

FOREIGN PATENT DOCUMENTS

CN 201861563 U 6/2011
CN 203662686 6/2014

(Continued)

OTHER PUBLICATIONS

EPO Machine Translation of Specification for JP2006-312066 (Year: 2006).*

(Continued)

*Primary Examiner* — Bryan R Muller
(74) *Attorney, Agent, or Firm* — Grossman Tucker Perreault & Pfleger, PLLC

(57) ABSTRACT

A surface cleaning head with dual rotating agitators (e.g., a leading roller and a brush roll) may be used to facilitate capturing of debris in the air flow into a suction conduit on the underside of the surface cleaning head. The leading roller is generally positioned adjacent to and in advance of the opening of the suction conduit. The rotating brush roll (Continued)

may be located in the suction conduit with the leading roller located in front of and spaced from the brush roll, forming an inter-roller air passageway therebetween. The leading roller may provide a softer cleaning element than the brush roll and may also have an outside diameter that is less than the outside diameter of the brush roll. The surface cleaning head may also include debriding protrusions contacting the leading roller and/or a leading bumper that extends in front of the leading roller.

12 Claims, 15 Drawing Sheets

Related U.S. Application Data filed on Oct. 30, 2015, provisional application No. 62/313,394, filed on Mar. 25, 2016.

(51) Int. Cl.
*A47L 9/06* (2006.01)
*A47L 5/30* (2006.01)
*A47L 9/30* (2006.01)

(52) U.S. Cl.
CPC ..... *A47L 9/0477* (2013.01); *A47L 9/0494* (2013.01); *A47L 9/0606* (2013.01); *A47L 9/0673* (2013.01); *A47L 9/30* (2013.01)

(58) Field of Classification Search
USPC ..... 15/384
See application file for complete search history.

(56) References Cited

U.S. PATENT DOCUMENTS 2,607,062 A 8/1952 Le Febvre
2,785,431 A 3/1957 Pardee
4,138,762 A 2/1979 Jost et al.
4,173,807 A 11/1979 Maier
4,333,205 A 6/1982 Woodward et al.
4,334,337 A 6/1982 Miller et al.
4,372,004 A * 2/1983 Vermillion ..... A46B 7/04 15/182
4,627,127 A 12/1986 Dupre
4,662,027 A 5/1987 Parker et al.
4,912,805 A 4/1990 Krasznai et al.
D348,548 S 7/1994 Pino
5,452,490 A 9/1995 Brundula et al.
5,495,634 A 3/1996 Brundula et al.
5,632,060 A 5/1997 Steinberg et al.
5,765,258 A 6/1998 Melito et al.
5,960,514 A 10/1999 Miller et al.
6,012,200 A 1/2000 Murphy et al.
D440,019 S 4/2001 Mehaffey et al.
6,226,832 B1 5/2001 McCormick
6,237,188 B1 5/2001 Takemoto et al.
D473,687 S 4/2003 Kaffenberger
6,550,099 B2 4/2003 Worwag
7,013,528 B2 3/2006 Parker et al.
D524,498 S 7/2006 Luebbering et al.
7,171,723 B2 2/2007 Kobayashi et al.
7,200,893 B2 4/2007 Gerber et al.
7,316,050 B2 1/2008 Worwag
7,328,479 B2 2/2008 Willenbring
7,329,294 B2 2/2008 Conrad
D566,356 S 4/2008 Medema
D569,564 S 5/2008 Labarbera
D594,612 S 6/2009 Umeda
D597,268 S 7/2009 Santiago et al.
7,690,079 B2 4/2010 Boddy et al.
D619,315 S 7/2010 Ayers
7,769,490 B2 8/2010 Abramson et al.
D635,728 S 4/2011 Fjellman
7,979,952 B2 7/2011 Beskow et al.
8,037,571 B2 10/2011 Butts et al.
D655,468 S 3/2012 Karsan
D668,010 S 9/2012 Stickney et al.
8,316,503 B2 11/2012 Follows et al.
8,402,600 B2 3/2013 Beskow et al.
8,402,601 B2 3/2013 Fahlstrom
D681,291 S 4/2013 Morgan et al.
8,418,303 B2 4/2013 Kapoor et al.
8,631,541 B2 1/2014 Tran
8,726,441 B1 5/2014 Colasanti et al.
8,745,818 B2 6/2014 Iles et al.
8,776,311 B2 7/2014 Genn et al.
8,782,851 B2 7/2014 Follows et al.
8,800,107 B2 8/2014 Blouin
8,806,710 B2 8/2014 Follows et al.
D720,104 S 12/2014 Santiago et al.
9,021,655 B2 5/2015 Owen et al.
9,027,198 B2 5/2015 Conrad
D731,130 S 6/2015 Dyson et al.
D731,134 S 6/2015 Dyson et al.
D731,136 S 6/2015 Yun et al.
D731,720 S 6/2015 Gidwell et al.
D731,724 S 6/2015 Cheon et al.
9,066,640 B2 6/2015 Iles et al.
D738,583 S 9/2015 Gidwell et al.
D738,584 S 9/2015 Niedzwecki
9,144,356 B2 9/2015 Yun
D741,558 S 10/2015 Kerr
D742,083 S 10/2015 Gidwell et al.
D743,123 S 11/2015 Chu
D745,231 S 12/2015 Niedzwecki
D747,571 S 1/2016 Dyson
D747,572 S 1/2016 Kerr
9,314,140 B2 4/2016 Eriksson
D761,507 S 7/2016 Heck et al.
D762,031 S 7/2016 Niedzwecki
9,451,853 B2 9/2016 Conrad et al.
D770,111 S 10/2016 Lee et al.
9,456,723 B2 10/2016 Thorne et al.
9,468,346 B1 10/2016 Rzepka
D771,890 S 11/2016 Kim
D772,512 S 11/2016 Yoon et al.
D773,139 S 11/2016 Palladino
D774,260 S 12/2016 Manning
D774,264 S 12/2016 Bartram et al.
D779,751 S 2/2017 Chu
D779,752 S 2/2017 Johnson
D781,014 S 3/2017 Wu et al.
D788,393 S 5/2017 Canas et al.
D789,007 S 6/2017 Jang et al.
D790,785 S 6/2017 Courtney et al.
D792,665 S 7/2017 Salagnac
D796,134 S 8/2017 Labarbera
D796,136 S 8/2017 Reynolds et al.
2002/0124334 A1 9/2002 Worwag
2003/0106183 A1 6/2003 Frederick et al.
2003/0145424 A1 8/2003 Stephens et al.
2003/0159240 A1 8/2003 Mertes
2004/0045125 A1 3/2004 Park et al.
2005/0172447 A1 8/2005 Roney et al.
2006/0037170 A1 2/2006 Shimizu
2006/0191097 A1 8/2006 Baumhakel
2009/0229075 A1 9/2009 Eriksson
2010/0107359 A1 5/2010 Yoo
2010/0287717 A1 11/2010 Jang et al.
2010/0306958 A1 12/2010 Follows et al.
2011/0219571 A1 9/2011 Dyson et al.
2011/0296648 A1 12/2011 Kah, Jr.
2012/0000030 A1 1/2012 Conrad
2012/0011676 A1 1/2012 Jung et al.
2012/0169497 A1 7/2012 Schnittman et al.
2012/0198644 A1 8/2012 Iles
2012/0311802 A1 12/2012 Hinnant
2012/0311813 A1 12/2012 Gilbert, Jr. et al.
2013/0139349 A1* 6/2013 Iles ..... A47L 9/0488 15/383
2013/0212831 A1 8/2013 Follows et al.
2013/0298350 A1 11/2013 Schnittman et al.

(56) References Cited

U.S. PATENT DOCUMENTS

| | | | | |
|---|---|---|---|---|
| 2014/0060577 | A1 | 3/2014 | Bruders et al. | |
| 2014/0150202 | A1* | 6/2014 | Schultheis | A46B 7/044 15/398 |
| 2014/0196247 | A1 | 7/2014 | Kasper et al. | |
| 2014/0237760 | A1 | 8/2014 | Conrad | |
| 2014/0259475 | A1 | 9/2014 | Doughty | |
| 2014/0259521 | A1 | 9/2014 | Kowalski | |
| 2015/0033498 | A1 | 2/2015 | McVey | |
| 2015/0289735 | A1 | 10/2015 | Van Der Kooi et al. | |
| 2015/0359396 | A1 | 12/2015 | Yun | |
| 2016/0058257 | A1 | 3/2016 | Ventress et al. | |
| 2016/0183749 | A1 | 6/2016 | Isley et al. | |
| 2016/0220082 | A1 | 8/2016 | Thorne et al. | |
| 2016/0345795 | A1 | 12/2016 | Manning | |
| 2017/0079493 | A1 | 3/2017 | Genn et al. | |
| 2017/0127896 | A1 | 5/2017 | Carter et al. | |
| 2017/0215667 | A1 | 8/2017 | Thorne et al. | |
| 2017/0231445 | A1 | 8/2017 | Kasper | |
| 2017/0332859 | A1 | 11/2017 | Nam et al. | |
| 2018/0199784 | A1 | 7/2018 | Schnittman et al. | |

FOREIGN PATENT DOCUMENTS

| | | | |
|---|---|---|---|
| CN | 205181249 | U | 4/2016 |
| CN | 206080407 | U | 4/2017 |
| DE | 102010017211 | A1 | 12/2011 |
| DE | 102010017258 | A1 | 12/2011 |
| EP | 0909547 | A2 | 4/1999 |
| EP | 1994869 | | 11/2008 |
| EP | 2289381 | A2 | 3/2011 |
| EP | 2218385 | A3 | 3/2013 |
| EP | 2543301 | | 9/2013 |
| EP | 3187083 | | 7/2017 |
| GB | 360577 | | 11/1931 |
| GB | 583738 | | 12/1946 |
| GB | 877778 | A | 9/1961 |
| GB | 2109224 | | 6/1983 |
| GB | 2285777 | A | 7/1995 |
| GB | 2476811 | | 7/2011 |
| GB | 2509925 | B | 7/2014 |
| GB | 2529819 | | 9/2016 |
| JP | S507359 | | 1/1975 |
| JP | S59174143 | U | 11/1984 |
| JP | 03228721 | A | 10/1991 |
| JP | 05228083 | A | 9/1993 |
| JP | H06248499 | A | 10/1994 |
| JP | H07322981 | A | 12/1995 |
| JP | 2639155 | B2 | 8/1997 |
| JP | H10127542 | A | 5/1998 |
| JP | H10201682 | A | 8/1998 |
| JP | H11028178 | A | 2/1999 |
| JP | H11187997 | A | 7/1999 |
| JP | 2000033059 | A | 2/2000 |
| JP | 2001120473 | A | 5/2001 |
| JP | 2003339589 | A | 12/2003 |
| JP | 2004222912 | A | 8/2004 |
| JP | 2005046262 | A | 2/2005 |
| JP | 2006247229 | A | 9/2006 |
| JP | 2006312066 | A * | 11/2006 |
| JP | 2006312066 | A | 11/2006 |
| JP | 2007068835 | | 3/2007 |
| JP | 2008000382 | | 1/2008 |
| JP | 2009045503 | A | 3/2009 |
| JP | 2011050428 | A | 3/2011 |
| JP | 2013013590 | A | 1/2013 |
| JP | 2013052238 | A | 3/2013 |
| JP | 2014033738 | A | 2/2014 |
| JP | 2014509211 | A | 4/2014 |
| JP | 2015000210 | | 1/2015 |
| JP | 2015116414 | A | 6/2015 |
| JP | 2016504100 | A | 2/2016 |
| JP | 2017074258 | A | 4/2017 |
| JP | 2017121468 | A | 7/2017 |
| KR | 20040052092 | A | 6/2004 |
| KR | 100593324 | B1 | 6/2006 |
| WO | 9210967 | A1 | 7/1992 |
| WO | 0141618 | A1 | 6/2001 |
| WO | 2009117383 | | 9/2009 |
| WO | 2011083294 | A1 | 7/2011 |
| WO | 2013104886 | A1 | 7/2013 |
| WO | 2014131105 | A1 | 9/2014 |
| WO | 2014131106 | A1 | 9/2014 |
| WO | 2014177216 | | 11/2014 |
| WO | 2015015166 | | 2/2015 |
| WO | 2015015167 | | 2/2015 |
| WO | 2016034848 | | 3/2016 |
| WO | 2017070492 | A1 | 4/2017 |

OTHER PUBLICATIONS

PCT Search Report and Written Opinion dated Dec. 26, 2018, received in PCT Application No. PCT/US18/47525, 14 pgs.

Australian Examination Report dated Oct. 23, 2018, received in AU Application No. 2016341998, 5 pgs.

Australian Examination Report dated Oct. 16, 2018, received in AU Application No. 2016342001, 5 pgs.

International Search Report and Written Opinion dated Mar. 17, 2017 in corresponding PCT Patent Application No. PCT/US 16/58155, 12 pgs.

International Search Report and Written Opinion dated Mar. 24, 2017 in corresponding PCT Patent Application No. PCT/US 16/58148, 14 pgs.

PCT Search Report and Written Opinion dated Aug. 23, 2018, received in PCT Application No. PCT/US18/34320, 11 pgs.

PCT Search Report and Written Opinion dated Jul. 18, 2018, received in PCT Application No. PCT/US18/28635, 16 pgs.

Extended European Search Report dated Mar. 28, 2019, received in EP Application No. 16858305.2, 7 pgs.

English translation of Japanese Office Action dated May 21, 2019, received in Japanese Application No. 2018-520541, 11 pgs.

English translation of Korean Office Action dated Apr. 30, 2019, received in Korean Application No. 10-2018-7014180, 11 pgs.

U.S. Office Action dated May 15, 2019, received in U.S. Appl. No. 15/492,320, 13 pgs.

Extended European Search Report dated Apr. 3, 2019, received in EP Application No. 16858308.6, 7 pgs.

English translation of Japanese Office Action dated Apr. 1, 2019, received in Japanese Application No. 2017-557189, 6 pgs.

English translation of Japanese Office Action dated Dec. 2, 2019, received in JP Application No. 2018-520541, 6 pgs.

English translation of Korean Office Action dated Nov. 27, 2019, received in Korean Application No. 10-2018-7014180, 5 pgs.

U.S. Office Action dated Sep. 17, 2019, received in U.S. Appl. No. 15/685,456, 11 pgs.

U.S. Office Action dated Oct. 23, 2019, received in U.S. Appl. No. 15/492,320, 14 pgs.

English translation of Korean Office Action dated May 31, 2019, received in Korean Application No. 10-2018-7014186, 8 pgs.

English translation of Japanese Decision of Rejection dated Jan. 6, 2020, received in Japanese Application No. 2017-557189, 5 pgs.

Chinese Office Action with English translation dated Feb. 25, 2020, received in Chinese Patent Application No. 201610921399.6, 18 pgs.

Chinese Office Action with English translation dated Mar. 2, 2020, received in Chinese Patent Application No. 201711481216.4, 16 pgs.

Chinese Office Action with English translation dated Mar. 25, 2020, received in Chinese Patent Application No. 201711405708.5, 11 pgs.

U.S. Office Action dated Mar. 17, 2020, received in U.S. Appl. No. 15/768,879, 25 pgs.

Chinese Office Action with English translation dated Jan. 2, 2020, received in Chinese Patent Application No. 201680061488.6, 11 pgs.

Chinese Office Action with English translation, dated Jul. 31, 2020, received in China Application No. 201610921399.6, 21 pgs.

(56) References Cited

OTHER PUBLICATIONS

PCT International Search Report and Written Opinion dated Mar. 31, 2016, received in corresponding PCT Application No. PCT/US16/15370, 15 pgs.
3rd Party Observation filed Jul. 13, 2020 in EP Application No. 20160744107, 7 pgs.
U.S. Office Action dated Feb. 22, 2016, received in related U.S. Appl. No. 14/744,438, 29 pgs.
Australian Examination Report dated Jun. 24, 2021, received in Australian Patent Application No. 2021201452, 6 pages.
Chinese Decision of Rejection with English translation dated Jun. 8, 2021 received in Chinese Patent Application No. 201711405708.5, 6 pages.
Office Action dated May 3, 2021, received in Canadian Patent Application No. 3,073,677, 6 pages.
Chinese Office Action with English translation, dated May 22, 2020, received in China Applicatin No. 201810965394.2, 20 pgs.
Chinese Office Action with English translation, dated May 26, 2020, received in China Application No. 201810516731.X, 13 pgs.
Korean Office Action with English translation, dated Aug. 31, 2020, received in Korean Application No. 10-2020-7018384, 7 pgs.
Chinese Office Action with English translation, dated Oct. 15, 2020, received in China Application No. 201610921399.6, 21 pgs.
Australian Examination Report dated Jun. 11, 2020, received in Australian Application No. 2019246800, 7 pgs.
European Search Report dated Nov. 27, 2020, received in EP Application No. 18806820.9, 7 pgs.
U.S. Office Action dated Sep. 1, 2020, received in U.S. Appl. No. 15/492,320, 14 pgs.
U.S. Office Action dated Nov. 2, 2020, received in U.S. Appl. No. 15/987,589, 15 pgs.
Japanese Office Action with English translation, dated Jan. 21, 2021, received in JP Application No. 2017-557189, 27 pgs.
Canadian Examiner Report dated Feb. 8, 2021, received in Canada Patent Application No. 3,064,747, 4 pages.
Korean Office Action with English translation dated Mar. 19, 2021, received in Korean Patent Application No. 10-2020-7006909, 15 pages.
Japanese Office Action with English translation dated Mar. 22, 2021, received in Japanese Patent Application No. 2020-510098, 15 pages.
Chinese Office Action with English translation dated Jan. 6, 2021, received in Chinese Patent Application No. 201711481216.4, 11 pages.
Japanese Office Action with English translation dated Jan. 26, received in Japanese Patent Application No. 2019-564874, 9 pages.
Chinese Office Action with English translation dated Apr. 13, 2021, received in Chinese Patent Application No. 201810516731.X, 13 pages.
Japanese Office Action with English translation dated Jan. 26, 2021, received in Japanese Patent Application No. 2019-556824, 11 pages.
Chinese Decision of Rejection dated May 7, 2021, received in China Application No. 201680061488.6, 9 pgs.
Japanese Office Action with English translation dated Jul. 9, 2021, received in Japanese Patent Application No. 2020-08880, 8 pages.
Australian Examination Report dated May 5, 2021, received in Australian Patent Application No. 2021201726, 3 pages.
Chinese Office Action with English translation dated Aug. 31, 2021, received in Chinese Patent Application No. 202011084724.0, 8 pages.
European Extended Search Report dated Jul. 13, 2021, received in European Patent Application No. 18848114.7, 5 pages.
Korean Office Action with English translation dated Aug. 2, 2021, received in Korean Patent Application No. 10-2020-7006909, 14 pages.
Chinese Office Action with English translation dated Dec. 9, 2020, received in Chinese Patent Application No. 201711405708.5, 7 pages.
U.S. Office Action dated Dec. 16, 2021, received in U.S. Appl. No. 15/492,320, 17 pages.
Korean Office Action with machine translation dated Jan. 18, 2022, received in Korean Patent Application No. 10-2019-7034239, 10 pages.

* cited by examiner

SURFACE CLEANING HEAD WITH DUAL ROTATING AGITATORS

CROSS-REFERENCE TO RELATED APPLICATIONS

The present disclosure claims the benefit of U.S. Provisional Patent Application Ser. No. 62/244,331 filed Oct. 21, 2015, U.S. Provisional Patent Application Ser. No. 62/248,813 filed Oct. 30, 2015, and U.S. Provisional Patent Application Ser. No. 62/313,394 filed Mar. 25, 2016, all of which are fully incorporated herein by reference.

TECHNICAL FIELD

The present disclosure relates to vacuum cleaners and more particularly, to a vacuum cleaner surface cleaning head with dual rotating agitators such as a leading roller and a brush roll.

BACKGROUND INFORMATION

Vacuum cleaners generally include a suction conduit with an opening on the underside of a surface cleaning head for drawing air (and debris) into and through the surface cleaning head. One of the challenges with vacuum cleaner design is to control engagement of the suction conduit with a surface being cleaned to provide the desired amount of suction. If the suction conduit is spaced too far from a surface, the suction may be less because the air is flowing into the suction conduit through a greater surface area. If the suction conduit is directly engaged with the surface and thus sealed on all sides, air will stop flowing into the suction conduit and the suction motor may be damaged as a result.

Vacuum cleaners also generally use agitation to loosen debris and facilitate capturing the debris in the flow of air into the suction conduit. Agitators are often used in the suction conduit of a surface cleaning head proximate a dirty air inlet to cause the agitated debris to flow into the dirty air inlet. If the agitator in the suction conduit is unable to loosen the debris or if the debris is too small, the suction conduit may pass over the debris without removing the debris from the surface. In other cases, the surface cleaning head may push larger debris forward without ever allowing the debris to be captured in the flow into the suction conduit (sometimes referred to as snowplowing).

SUMMARY

Consistent with an embodiment, a surface cleaning head includes a housing having a front side and back side. The housing defines a suction conduit with an opening on an underside of the housing between the front side and the back side. The surface cleaning head also includes a brush roll rotatably mounted to the housing within the suction conduit and proximate the opening of the suction conduit, and a leading roller mounted to the housing in front of the brush roll and spaced from the brush roll to define an inter-roller air passageway between lower portions of the brush roll and the leading roller. The lower portion of the leading roller is adjacent the opening of the suction conduit and exposed to a flow path to the suction conduit and at least an upper half of the leading roller is outside of the flow path to the suction conduit. The leading roller has a diameter Dlr in the range of 0.3 Dbr to 0.8 Dbr, wherein Dbr is the diameter of the brush roll. The leading roller includes a cleaning element that is softer than a cleaning element of the brush roll.

Consistent with another embodiment, a surface cleaning head includes a housing having a front side and back side. The housing defines a suction conduit with an opening on an underside of the housing between the front side and the back side. The surface cleaning head also includes a brush roll rotatably mounted to the housing within the suction conduit and proximate the opening of the suction conduit, and a leading roller mounted to the housing in front of and spaced from the brush roll and adjacent to the opening of the suction conduit. A series of spaced debriding protrusions are located in the housing and contact the leading roller without contacting the brush roll. At least a portion of the debriding protrusions are angled downward toward the opening of the suction conduit and contact the leading roller at a location above a bottom contact surface of the leading roller.

Consistent with a further embodiment, a surface cleaning head includes a housing having a front side and back side. The housing defines a suction conduit with an opening on an underside of the housing between the front side and the back side. The surface cleaning head further includes a brush roll rotatably mounted to the housing within the suction conduit and proximate the opening of the suction conduit and a leading roller mounted to the housing in front of the brush roll and adjacent the opening of the suction conduit. A front portion of the leading roller is at least partially exposed at the front side of the housing. The surface cleaning head further includes a bumper on the front side of the housing that extends at least laterally across a top of the front side of the housing. At least a portion of the bumper provides a leading edge in front of the leading roller such that the bumper contacts a vertical surface before the leading roller.

Consistent with yet another embodiment, a surface cleaning head includes a housing having a front side and back side. The housing defines a suction conduit with an opening on an underside of the housing between the front side and the back side. The surface cleaning head further includes a brush roll rotatably mounted to the housing within the suction conduit and proximate the opening of the suction conduit and a leading roller mounted to the housing in front of the brush roll and adjacent the opening of the suction conduit. At least one sealing strip is located on the underside of the housing along a rear side of the opening of the suction conduit and along at least a portion of left and right sides of the opening. The underside of the housing defines side edge vacuum passageways extending from left and right sides of the housing at least partially between the leading roller and ends of the sealing strip back towards the opening of the suction conduit to direct air to the opening.

BRIEF DESCRIPTION OF THE DRAWINGS

These and other features and advantages will be better understood by reading the following detailed description, taken together with the drawings wherein.

DETAILED DESCRIPTION

Figure 1:
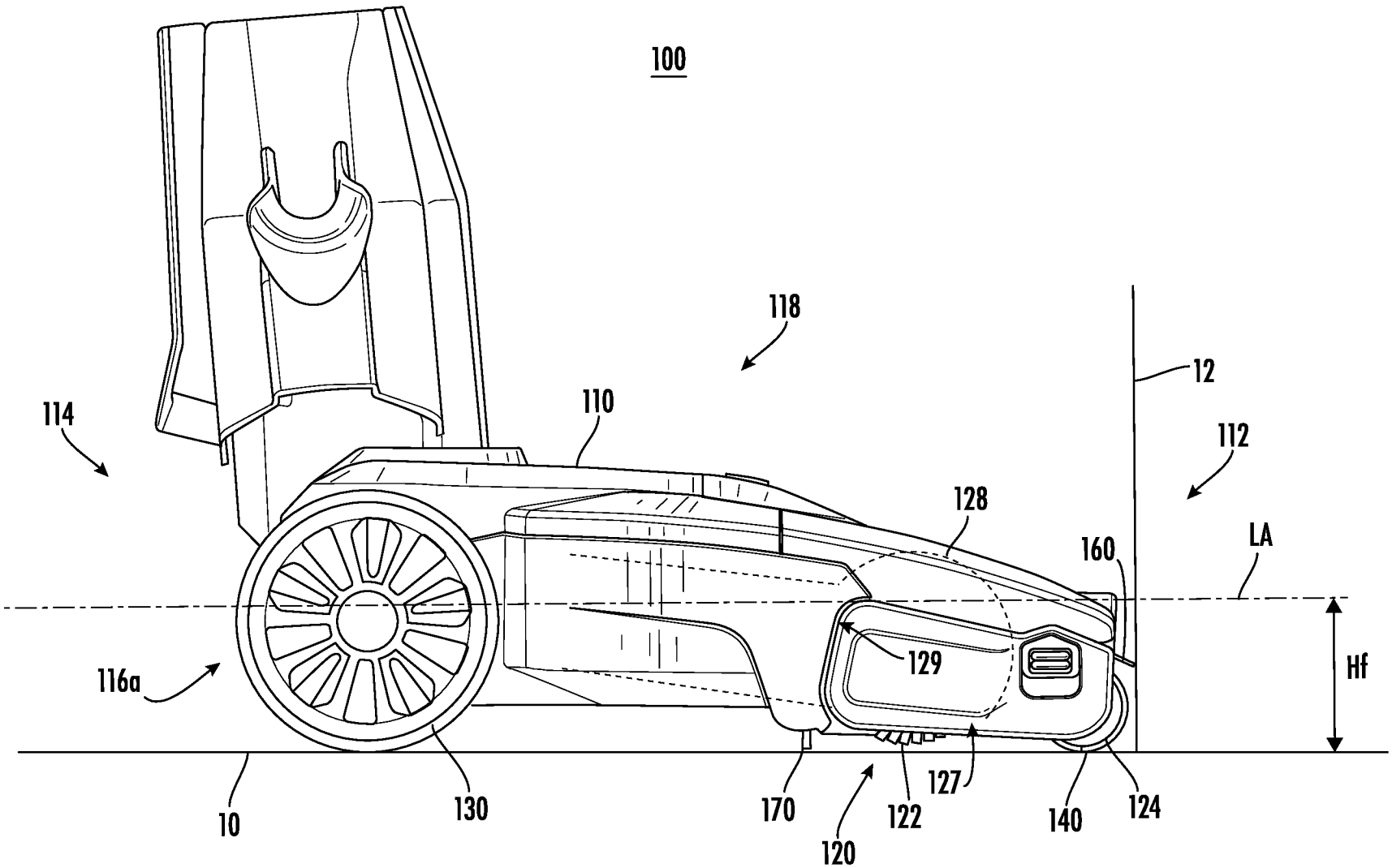
FIG. 1 is a side view of a surface cleaning head including dual agitators, consistent with an embodiment of the present disclosure.

A surface cleaning head with dual rotating agitators (e.g., a leading roller and a brush roll), consistent with embodiments of the present disclosure, may be used to facilitate capturing of debris in the air flow into a suction conduit on the underside of the surface cleaning head. The leading roller is generally positioned adjacent to and in advance of the opening of the suction conduit such that the leading roller engages debris and moves the debris toward the opening. At least a top half of the leading roller may be outside of the flow path to the suction conduit and a bottom portion of the leading roller may be exposed to the flow path to the suction conduit. The rotating brush roll may be located in the suction conduit with the leading roller located in front of and spaced from the brush roll, forming an inter-roller air passageway between lower portions of the leading roller and the brush roll. The leading roller may provide a softer cleaning element than the brush roll and may also have an outside diameter that is less than the outside diameter of the brush roll to provide a lower profile at a front side. The leading roller and the brush roll may also be rotatably driven by the same drive mechanism. In some embodiments, debriding protrusions may contact the leading roller above the inter-roller air passageway to facilitate debris removal into the flow path. In some embodiments, the surface cleaning head may include a leading bumper that extends in front of the leading roller to protect a front portion of the leading roller and facilitate front edge cleaning.

Although specific embodiments of the surface cleaning head with a leading roller are shown, other embodiments of the surface cleaning head with a leading roller are within the scope of the present disclosure. The surface cleaning head with a leading roller may be used in different types of vacuum cleaners including, without limitation, an "all in the head" type vacuum, upright vacuum cleaners, canister vacuum cleaners, stick vacuum cleaners, robotic vacuum cleaners and central vacuum systems. The surface cleaning head with a leading roller may also include removable agitators (e.g., brush rolls) in openable agitator chambers, such as the type described in greater detail in U.S. Pat. No. 9,456,723 and U.S. Patent Application Pub. No. 2016/0220082, which are commonly-owned and fully incorporated herein by reference. The leading roller may be similarly removable.

As used herein, a "surface cleaning head" refers to a device configured to contact a surface for cleaning the surface by use of suction air flow, agitation, or a combination thereof. A surface cleaning head may be pivotably or steeringly coupled by a swivel connection to a wand for controlling the surface cleaning head and may include motorized attachments as well as fixed surface cleaning heads. A surface cleaning head may also be operable without a wand or handle. As used herein, "seal" or "sealing" refers to preventing a substantial amount of air from passing through to the suction conduit but does not require an air tight seal. As used herein, "agitator" refers to any element, member or structure capable of agitating a surface to facilitate movement of debris into a suction air flow in a surface cleaning head. As used herein, "soft" and "softer" refer to the characteristics of a cleaning element being more compliant or pliable than another cleaning element. As used herein, the term "flow path" refers to the path taken by air as it flows into a suction conduit when drawn in by suction. As used herein, the terms "above" and "below" are used relative to an orientation of the surface cleaning head on a surface to be cleaned and the terms "front" and "back" are used relative to a direction that a user pushes the surface cleaning head on a surface being cleaned (i.e., back to front). As used herein, the term "leading" refers to a position in front of at least another component but does not necessarily mean in front of all other components.

Figure 2:
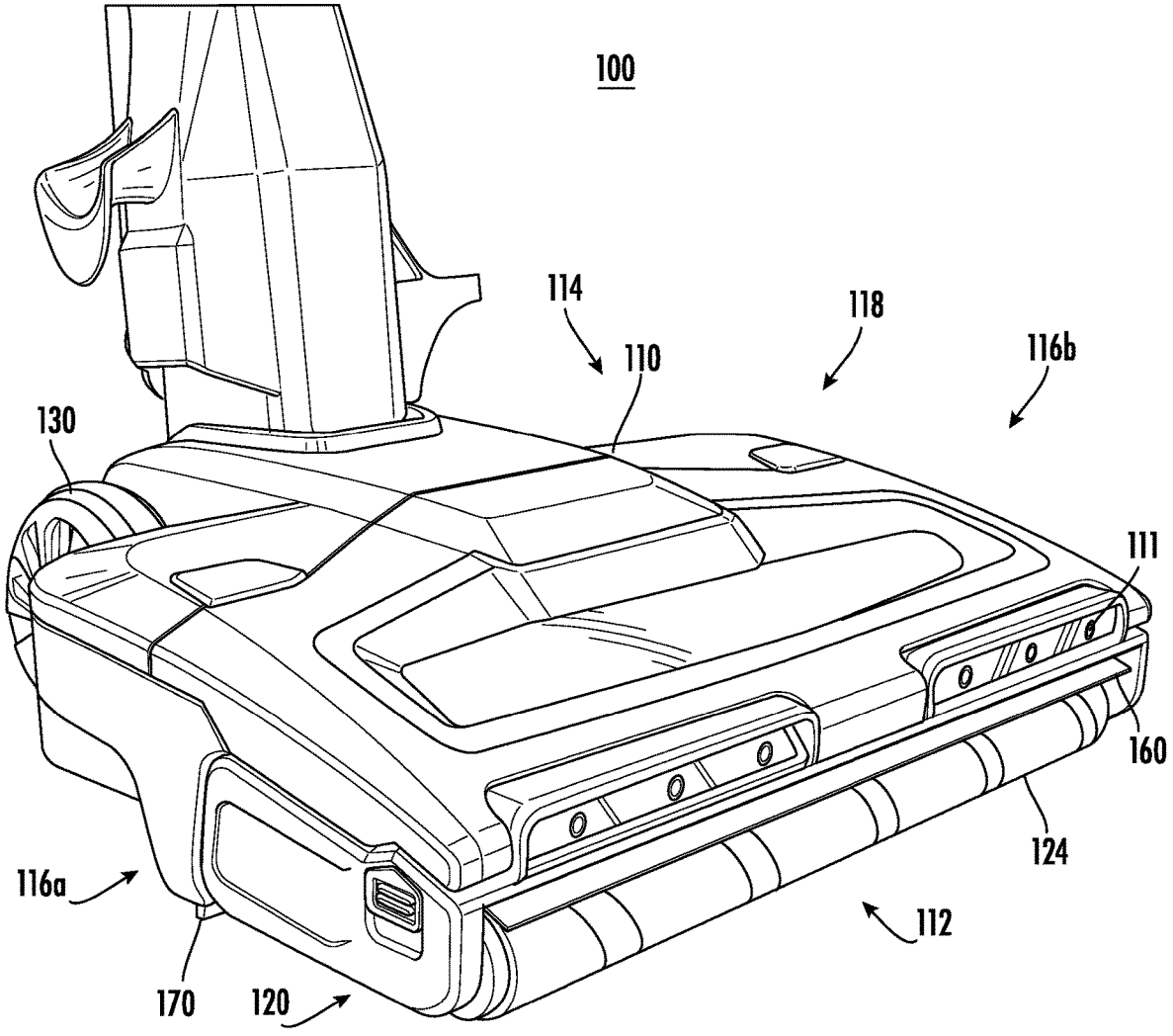
FIG. 2 is a front side perspective view of the surface cleaning head shown in FIG. 1.
Figure 3:
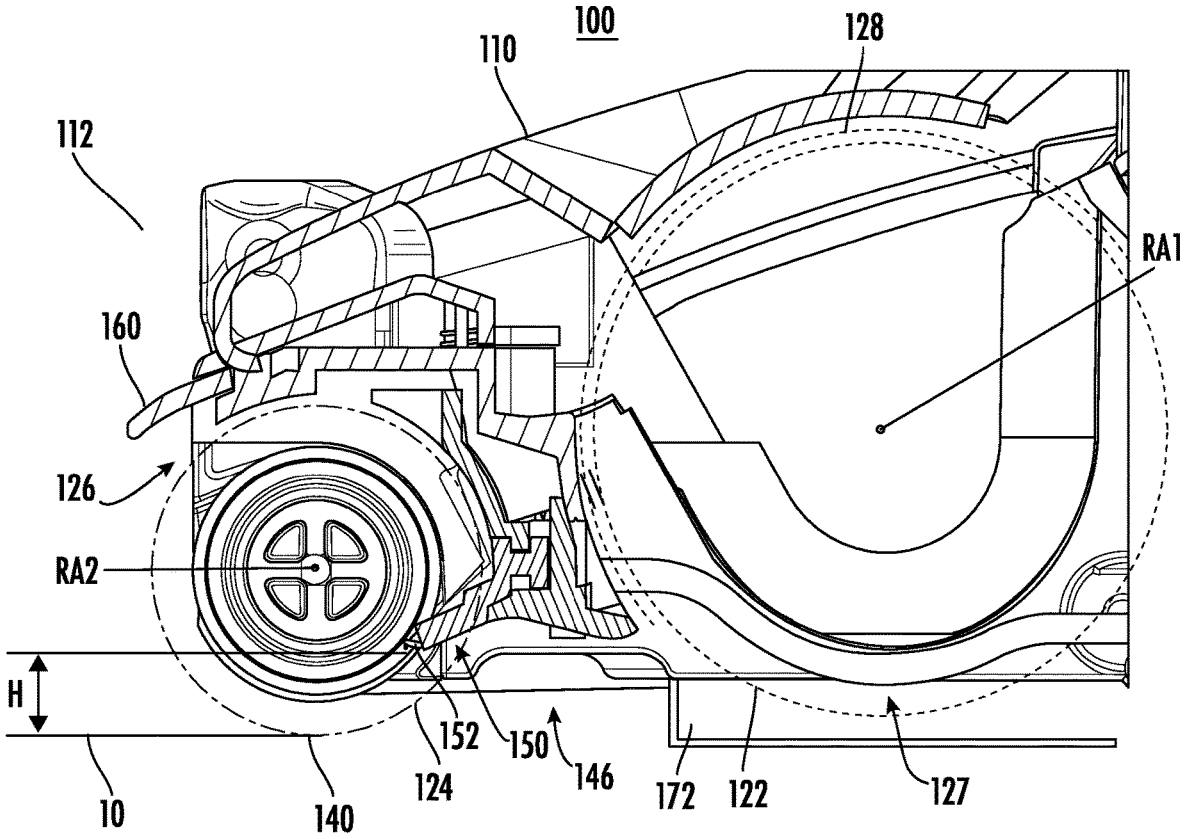
FIG. 3 is a side cross-sectional view of a portion of the surface cleaning head shown in FIG. 1.

Referring to FIGS. 1-3, a surface cleaning head 100 including dual agitators, consistent with an embodiment of the present disclosure, is shown and described. The surface cleaning head includes a housing 110 with a front side 112, and a back side 114, left and right sides 116*a*, 116*b*, an upper side 118, and a lower or under side 120. The housing 110 defines a suction conduit 128 having an opening 127 on the underside 120 of the housing (shown schematically in FIGS. 1 and 3). The suction conduit 128 is fluidly coupled to a dirty air inlet 129, which leads to a suction motor (not shown) either in the surface cleaning head 100 or another location in the vacuum. The suction conduit 128 is the interior space defined by interior walls in the housing 110, which receives and directs air drawn in by suction, and the opening 127 is where the suction conduit 128 meets the underside 120 of the housing 110. Although an embodiment of the housing 110 is described herein for illustrative purposes, the housing 110 and components thereof may have other shapes and configurations.

The surface cleaning head 100 includes dual rotating agitators 122, 124, for example, a brush roll 122 and a leading roller 124. The brush roll 122 and leading roller 124 may be configured to rotate about first and second rotating axes (RA1, RA2), respectively, that generally extend perpendicular to a longitudinal axis LA of the surface cleaning head 100 (e.g., generally perpendicular to the intended direction of the vacuuming movement of the surface cleaning head 100 and/or generally parallel to the front side 112).

The rotating brush roll 122 and/or the leading roller 124 may be coupled to, and rotated about the rotating axes, by one or more motors.

The rotating brush roll 122 is at least partially disposed within the suction conduit 128 (shown schematically in broken lines in FIG. 3). The leading roller 124 is positioned in front of and spaced from the brush roll 122 and at least substantially outside the suction conduit 128. As shown in FIG. 3, at least an inside upper portion (e.g., at least an inside upper half) of the leading roller 124 is not exposed to the flow path into the opening 127 of the suction conduit 128 while at least an inside of the bottom portion of the leading roller 124 is exposed to the flow path into the opening 127 of the suction conduit 128. The leading roller 124 is received in a leading roller chamber 126, which prevents the inside upper half of the leading roller 124 from being exposed to the flow path. Other variations are possible with different portions of the leading roller 124 being exposed and not exposed to the flow path. A space between lower portions of the leading roller 124 and the brush roll 122 forms an inter-roller air passageway 146 that may provide at least a portion of the flow path into the opening 127 of the suction conduit 128 and allow debris to be carried into the suction conduit 128.

As shown, the brush roll 122 may be disposed in front of one or more wheels 130 for supporting the housing 110 on the surface 10 to be cleaned. For example, one or more larger wheels may be disposed along the back side 114 and/or one or more smaller middle wheels (not shown) may be provided at a middle section on the underside 116 of the housing 110 and/or along the left and right sides 116*a*, 116*b*. Other wheel configurations may also be used. The wheels 130 facilitate moving the surface cleaning head 100 along the surface 10 to be cleaned, and may also allow the user to easily tilt or pivot the surface cleaning head 100 (e.g., brush roll 122 and/or the leading roller 124) off of the surface 10 to be cleaned. The rear wheel(s) 130 and the middle wheel(s) may provide the primary contact with the surface being cleaned and thus primarily support the surface cleaning head 100. When the surface cleaning head 100 is positioned on the surface 10 being cleaned, the leading roller 124 may also rest on the surface 10 being cleaned. In other embodiments, the leading roller 124 may be positioned such that the leading roller 124 sits just above the surface being cleaned.

According to an embodiment, as shown in FIG. 3, one or more debriding protrusions 150 contact a surface of the leading roller 124 at a distance H above the bottom contact surface 140 of the leading roller 124 to facilitate debris removal. The debriding protrusions 150 are angled downward to contact a bottom portion of the leading roller 124 and are located above the inter-roller passageway 146 such that the removed debris falls into the inter-roller passageway 146 and into the flow path to the opening of the suction conduit 128. In this embodiment, the debriding protrusions 150 may include a plurality of hooks 152 (e.g., resilient hooks from a hook and loop type arrangement). The plurality of debriding hooks 152 may provide numerous contact points with leading roller 124 to remove debris from leading roller 124, while also reducing potential damage to the bristles of the leading roller 124. The debriding protrusions 150 may also substantially prevent air flow to a top of the leading roller 124 such that the upper half of the leading roller 124 is not exposed to the flow path to the suction conduit 128.

According to an embodiment, sealing strips 170, 172 are located along the rear and left and right sides of the opening 127 to the suction conduit 128. The sealing strips 170, 172 may contact the surface 10 being cleaned to seal against the surface together with the leading roller 124 contacting the surface 10 in front of the roller. Side edge vacuum passageways are thus formed between the side sealing strips 172 and the leading roller 124 to direct air into the inter-roller air passageway 146 and back towards the opening 127 of the suction conduit 128. As such, the side edge vacuum passageways and the inter-roller air passageway 146 provide at least a portion of the air flow path to the suction conduit 128.

The housing 110 is open at the front side 112 such that a front portion of the leading roller 124 is exposed to facilitate edge cleaning. According to an embodiment, the housing 110 include a front bumper 160 extends from the front side 112 of the housing 110 just beyond (or at least as far as) a front contact surface of the leading roller 124 such that the bumper 160 first contacts a vertical surface 12 to prevent damage to the leading roller 124. The bumper 160 may be sufficiently resilient to bend or compress to allow the leading roller 124 to contact the vertical surface 12 for edge cleaning.

The rotating brush roll 122 may have bristles, fabric, or other cleaning elements, or any combination thereof around the outside of the brush roll 122. Examples of brush rolls and other agitators are shown and described in greater detail in U.S. Pat. No. 9,456,723 and U.S. Patent Application Pub. No. 2016/0220082, which are fully incorporated herein by reference.

The leading roller 124 may include a relatively soft material (e.g., soft bristles, fabric, felt, nap or pile) arranged in a pattern (e.g., a spiral pattern) to facilitate capturing debris, as will be described in greater detail below. The leading roller 124 may be selected to be substantially softer than that of the brush roll 122. The softness, length, diameter, arrangement, and resiliency of the bristles and/or pile of the leading roller 124 may be selected to form a seal with a hard surface (e.g., but not limited to, a hard wood floor, tile floor, laminate floor, or the like), whereas the bristles of the brush roll 122 may selected to agitate carpet fibers or the like. For example, the leading roller 124 may be at least 25% softer than the brush roll 122, alternatively the leading roller 124 may be at least 30% softer than the brush roll 122, alternatively the leading roller 124 may be at least 35% softer than the brush roll 122, alternatively the leading roller 124 may be at least 40% softer than the brush roll 122, alternatively the leading roller 124 may be at least 50% softer than the brush roll 122, alternatively the leading roller 124 may be at least 60% softer than the brush roll 122. Softness may be determined, for example, based on the pliability of the bristles or pile being used.

Figure 18:
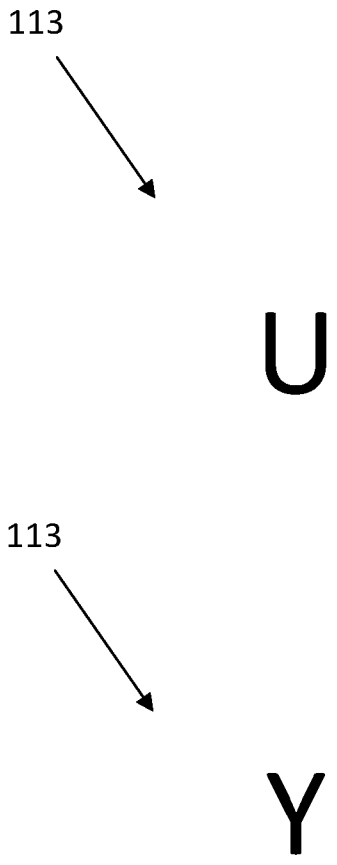

The size and shape of the bristles and/or pile may be selected based on the intended application. For example, the leading roller 124 may include bristles and/or pile having a length of between 5 to 15 mm (e.g., 7 to 12 mm) and may have a diameter of 0.01 to 0.04 mm (e.g., 0.01-0.03 mm). According to one embodiment, the bristles and/or pile may have a length of 9 mm and a diameter of 0.02 mm. The bristles and/or pile may have any shape. For example, the bristles and/or pile may be linear, arcuate, and/or may have a compound shape. According to one embodiment, the bristles and/or pile 113, FIG. 18, may have a generally U and/or Y shape. The U and/or Y shaped bristles and/or pile 113 may increase the number of points contacting the floor surface 10, thereby enhancing sweeping function of leading roller 124. The bristles and/or pile may be made on any material such as, but not limited to, Nylon 6 or Nylon 6/6.

Optionally, the bristles and/or pile of leading roller 124 may be heat treated, for example, using a post weave heat treatment. The heat treatment may increase the lifespan of the bristles and/or pile of the leading roller 124. For example, after weaving the fibers and cutting the velvet into rolls, the velvet may be rolled up and then run through a steam rich autoclave making the fibers/bristles more resilient fibers.

The leading roller 124 may have an outside diameter Dlr that is smaller than the outside diameter Dbr of the brush roll 122. For example, the diameter Dlr may be greater than zero and less than or equal to 0.8 Dbr, greater than zero and less than or equal to 0.7 Dbr, or greater than zero and less than or equal to 0.6 Dbr. According to example embodiments, the diameter Dlr may be in the range of 0.3 Dbr to 0.8 Dbr, in the range of 0.4 Dbr to 0.8 Dbr, in the range of 0.3 Dbr to 0.7 Dbr, or in the range of 0.4 Dbr to 0.7 Dbr. As an illustrative example, the brush roll 122 may have an outside diameter of 48 mm and the leading roller 124 may have an outside diameter of 30 mm. While the leading roller 124 may have an outside diameter Dlr that is smaller than the outside diameter Dbr of the brush roll 122, the brush roll 122 may have bristles that are longer than the bristle and/or pile of the leading roller 122.

Positioning a leading roller 124 (having a diameter Dlr that is smaller than the diameter Dbr of the brush roll 122) in front of the brush roll 122 provides numerous benefits. For example, this arrangement decreases the height Hf (see, e.g., FIG. 1) of the front side 112 of the surface cleaning head 100 (e.g., the housing 110) from the surface 10 to be cleaned. The decreased height Hf of the front of the surface cleaning head 100 provides a lower profile that allows the surface cleaning head 100 to fit under objects (e.g., furniture and/or cabinets). Moreover, the lower height Hf allows for the addition of one or more light sources 111 (such as, but not limited to, LEDs), while still allowing the surface cleaning head 100 to fit under objects.

Additionally, the smaller diameter Dlr of the leading roller 124 allows the rotating axis of the leading roller 124 to be placed closer to the front side 112 of the surface cleaning head 100. When rotating, the leading roller 124 forms a generally cylindrical projection having a radius that is based on the overall diameter of the leading roller 124. As the diameter of the leading roller 124 decreases, the bottom contact surface 140 (FIG. 1) of the leading roller 124 moves forward towards the front side 112 of the surface cleaning head 100. In addition, when the surface cleaning head 100 contacts a vertical surface 12 (e.g., but not limited to, a wall, trim, and/or cabinet), the bottom contact surface 140 of the leading roller 124 is also closer to the vertical surface 12, thereby enhancing the front edge cleaning of the surface cleaning head 100 compared to a larger diameter leading roller. Moreover, the smaller diameter Dlr of the leading roller 124 also reduces the load/drag on the motor driving the leading roller 124, thereby enhancing the lifespan of the motor and/or allowing a smaller motor to be used to rotate both the brush roll 122 and leading roller 124.

Referring to FIGS. 4-14, another embodiment of a surface cleaning head 400 with dual agitators is shown and described. The surface cleaning head 400 also includes a housing 410 with a front side 412, and a back side 414, left and right sides 416*a*, 416*b*, an upper side 418, and a lower or under side 420. The housing 410 defines a suction conduit 428 having an opening 427 on the underside 420 of the housing (shown in FIG. 5). The suction conduit 428 is fluidly coupled to a dirty air inlet 429, which leads to a suction motor (not shown) either in the surface cleaning head 400 or another location in the vacuum. The suction conduit 428 is the interior space defined by interior walls in the housing 410, which receives and directs air drawn in by suction, and the opening 427 is where the suction conduit 428 meets the underside 420 of the housing 410.

Figure 5:
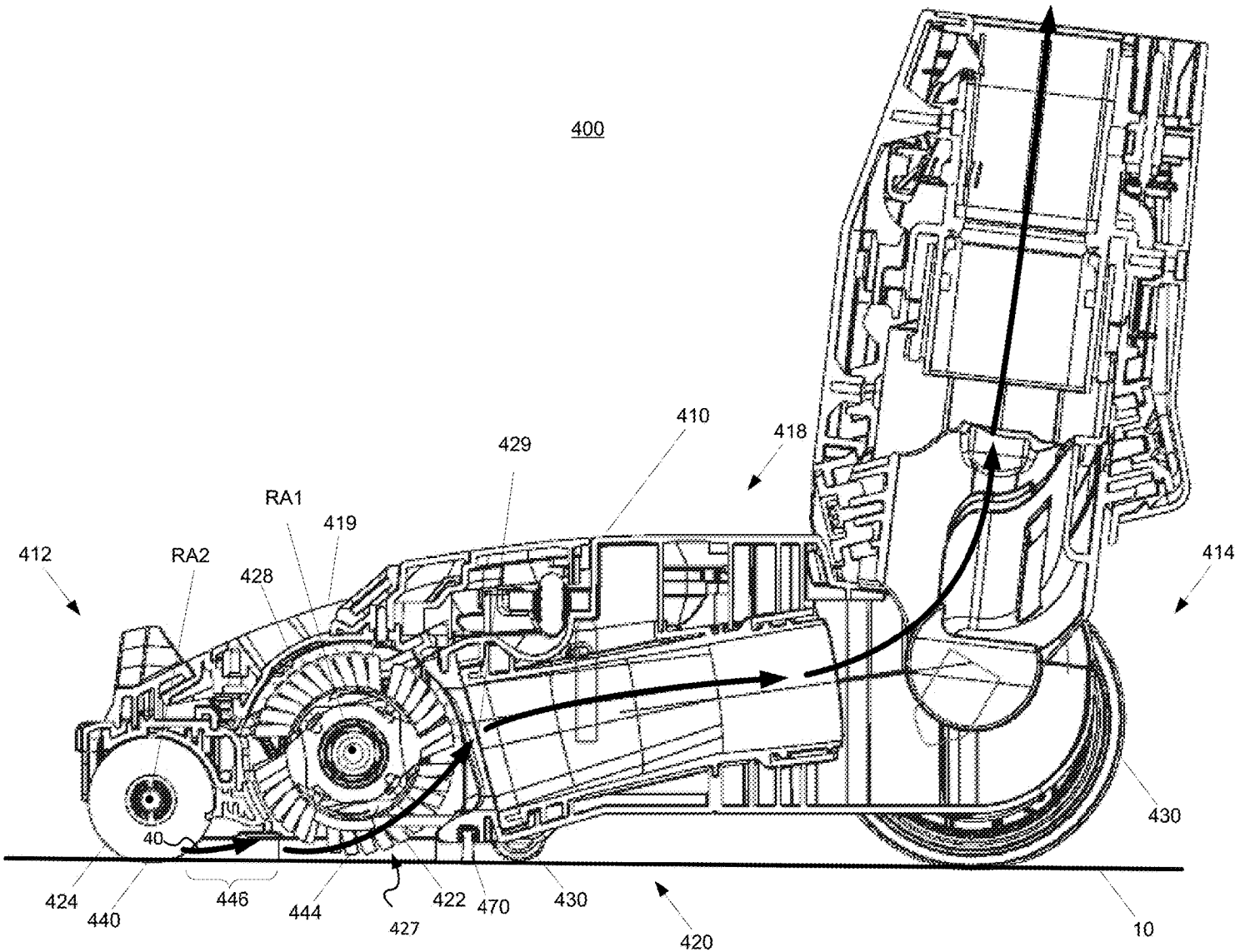
FIG. 5 is a side cross-sectional view of the surface cleaning head shown in FIG. 4 showing a flow path through a suction conduit.
Figure 6:
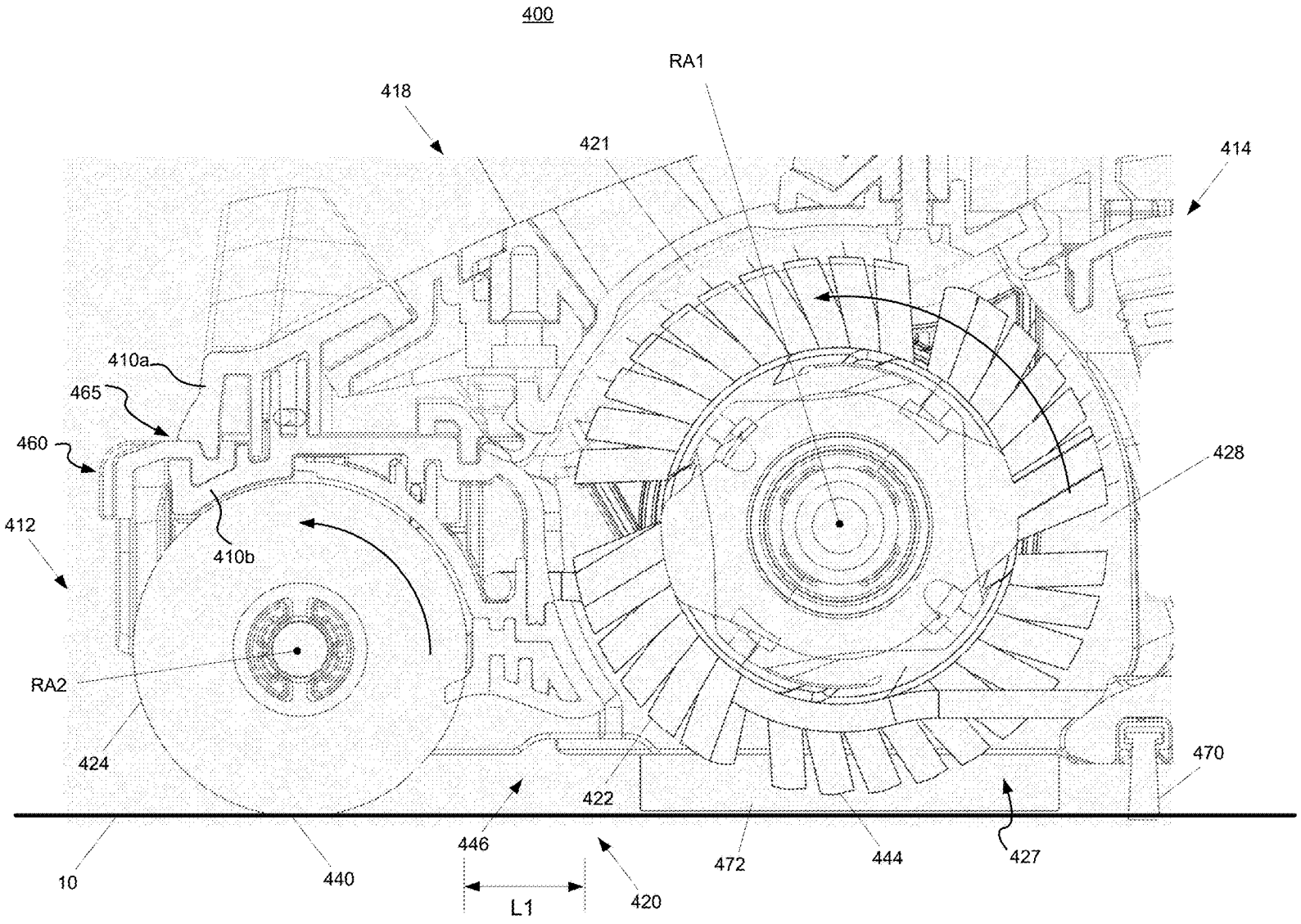
FIG. 6 is an enlarged side cross-sectional view illustrating the leading roller and brush roll of the surface cleaning head shown in FIG. 4.

The surface cleaning head 400 includes dual rotating agitators 422, 424, for example, a brush roll 422 and a leading roller 424. The brush roll 422 and leading roller 424 may be configured to rotate about first and second rotating axes (RA1, RA2). The rotating brush roll 422 is at least partially disposed within the suction conduit 428 (shown in FIGS. 5 and 6). The leading roller 424 is positioned in front of and spaced from the brush roll 422 and at least substantially outside the suction conduit 428. As shown in FIGS. 5 and 6, at least an inside upper portion (e.g., upper half) of the leading roller 424 is not exposed to the flow path (e.g., arrow 40) into the opening 427 of the suction conduit 428 while at least an inside of the bottom portion of the leading roller 424 is exposed to the flow path into the opening 427 of the suction conduit 428. Other variations are possible where different portions of the leading roller 424 may be exposed or not exposed to the flow path into the suction conduit 428. The leading roller 424 may rotate about the second rotation axis RA2 located within a leading roller chamber 426. The leading roller chamber 426 may have a size and shape slightly larger than the cylindrical projection of the leading roller 424 when the leading roller 424 is rotating therein.

Similar to the embodiment described above, the surface cleaning head 400 may include one or more wheels 430 for supporting the housing on the surface 10 to be cleaned. The brush roll 422 and the leading roller 424 in this embodiment of the surface cleaning head 400 may also have surface cleaning elements, sizes, and positions similar to those described above in connection with the surface cleaning head 100.

Figure 7:
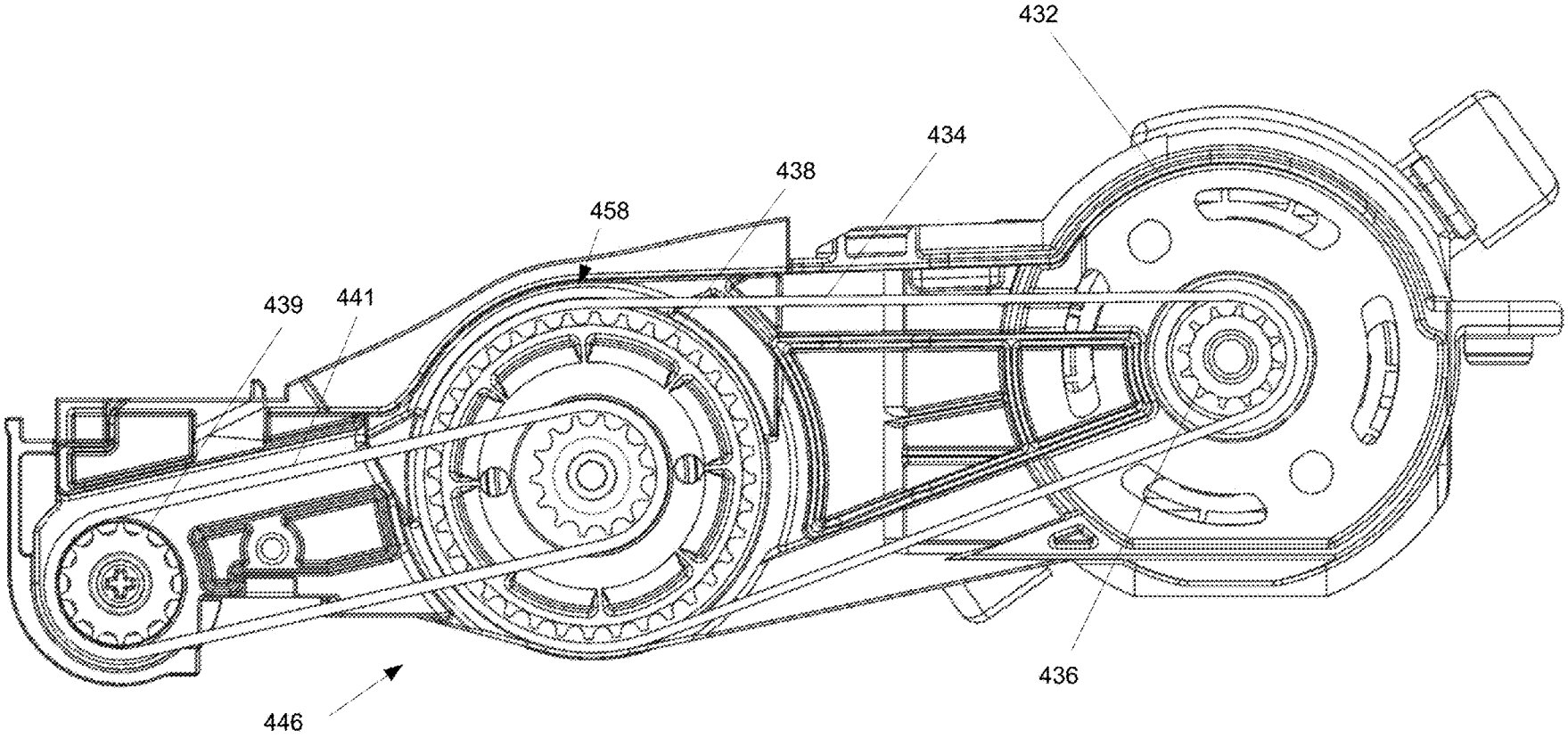
FIG. 7 is a side cross-sectional view illustrating a drive mechanism in the surface cleaning head shown in FIG. 4.

The rotating brush roll 422 may be coupled to an electrical motor (either AC or DC) to cause the rotating brush roll 422 to rotate about the first rotating axis. According to an embodiment, as shown in FIG. 7 for example, the rotating brush roll 422 is coupled to an electrical motor 432 by way of a first drive belt 434. One or more of the motor 132 and/or the rotating brush roll 422 includes a wheel and/or a gear 436, 438. For example, the first drive belt 434 includes teeth configured to engage optional teeth on one or more of the gears 436, 438. The rotation of the brush roll 422 relative to the motor 432 may be set by adjusting the ratios of one or more of the gears/wheels 436, 438. Although FIG. 7 illustrates one example of a driving mechanism for rotating the brush roll 422, other drive mechanisms are possible and within the scope of the present disclosure.

The leading roller 424 may be driven from the same drive mechanism (e.g., motor 432) used to drive the rotating brush roll 422. In the example embodiment, one or more of the brush roll 422 and/or the leading roller 424 includes a wheel and/or a gear 438, 439 coupled together by way of a second drive belt 441. The rotation of the leading roller 424 relative to the brush roll 422 and/or the motor 432 may be set by adjusting the ratios of one or more of the gears/wheels 436, 438, 439. Although FIG. 7 illustrates one example of a driving mechanism for rotating the leading roller 424, other drive mechanisms are possible and within the scope of the present disclosure. For example, the leading roller 424 may be rotated by a different motor.

In at least one embodiment, the brush roll 422 and the leading roller 424 rotate in the same direction, for example, counter clockwise as shown in FIG. 6. This arrangement may reduce the number of parts (e.g., no clutch or additional gear train may be necessary), thereby making the surface cleaning head 400 lighter, reducing drivetrain loss (thereby allowing for smaller/less expensive motors 432), and less expensive to manufacture. Optionally, the brush roll 422 and the leading roller 424 may rotate at same speed, thereby reducing the number of parts (e.g., no additional gear train necessary) and reducing drivetrain loss (thus, smaller/less expensive motor 432) and making the surface cleaning head 400 lighter and less expensive to manufacture.

As shown in FIG. 6, the leading roller 424 may be positioned within the housing 410 such that the bottom contact surface 440 is disposed closer to the surface 10 to be cleaned compared to the bottom contact surface 444 of the brush roll 422. This arrangement allows the leading roller 424 to contact a surface 10 (e.g., a hard surface) without the brush roll 422 contacting the hard surface 10. As may be appreciated, the leading roller 424 is intended to pick up debris from a hard surface 10 while the brush roll 422 is intended to primarily contact a carpet surface. This arrangement is therefore beneficial since it allows the leading roller 424 to form a seal between the front 412 of the surface cleaning head 400 with the hard surface 10, thereby enhancing airflow and suction with the hard surface 10. Additionally, this arrangement reduces the drag/torque on the drive motor(s) since the brush roll 422 (in some embodiments) does not have to contact the hard surface 10. The reduced drag/torque may allow for a smaller, less expensive motor and/or may increase the lifespan of the motor.

According to some embodiments, as shown in FIG. 6, the leading roller 424 is spaced apart a distance L1 (which is greater than 0 mm) from the brush roll 422 such that the leading roller 424 does not contact the brush roll 422. The distance L1 allows for an inter-roller vacuum passageway 446 between lower portions of the brush roll 422 and the leading roller 424, which provides at least a portion of the flow path into the opening 427 of the suction conduit 428. The inter-roller vacuum passageway 446 allows for debris that is either picked up by (and/or removed from) the leading roller 424 to be entrained in the vacuum flow generated by the surface cleaning head 400 and/or to be picked up by the brush roll 422, thereby enhancing the cleaning efficiency of the surface cleaning head 400. Additionally, the distance L1 reduces the load/drag on the motor(s), thereby enhancing the lifespan of the motor(s) and/or allowing smaller motors to be used to rotate both the brush roll 422 and the leading roller 424.

One or both of the leading roller 424 and the brush roll 422 may be removable. The leading roller 424 may be removably coupled to the housing 410 of the surface cleaning head 400. For example, a portion of the housing 410 (such as, but not limited to, a portion of the left and/or right side 416*a*, 416*b*) may be removably/hingedly coupled thereto. To remove the leading roller 424, the removable portion may be unsecured/uncoupled from the rest of the housing 410, thereby allowing the leading roller 424 to disengage from the drive wheel 439 and allowing the leading roller 424 to be removed from the leading roller chamber 426. Other ways of removably coupling the leading roller 424 within the housing 410 are also possible and within the scope of the present disclosure.

In some embodiments, the housing 410 of the surface cleaning head 400 may include a removable and/or hinged panel that allows the brush roll 422 to be removed. A shown in FIGS. 4 and 12, for example, the surface cleaning head 400 includes a panel 419 (FIG. 4) that may be removably and/or hingedly coupled to the housing 410. To remove the brush roll 422, the panel 419 may be disengaged from the housing 410 (e.g., removed) to allow the user to have access to a brush roll chamber 421 (see, e.g., FIGS. 6 and 12). Examples of removable panels or covers and removable brush rolls are described in greater detail in U.S. Pat. No. 9,456,723 and U.S. patent application Pub. No. 2016/0220082, which are fully incorporated herein by reference. Alternatively or additionally, the leading roller 424 may be removable in the same way.

The ability to remove the brush roll 422 and/or the leading roller 424 from the surface cleaning head 400 allows the brush roll 422 and/or the leading roller 424 to be cleaned more easily and may allow the user to change the size of the brush roll 422 and/or the leading roller 424, change type of bristles on the brush roll 422 and/or the leading roller 424, and/or remove the brush roll 422 and/or the leading roller 424 entirely depending on the intended application.

In some embodiments, the surface cleaning head 400 may also include a series of debriding protrusions 450 in contact with the leading roller 424, as shown in greater detail in FIGS. 8-11. The debriding protrusions 450 may be configured to remove debris (such as, but not limited to, hair, string, and the like) that may be wrapped around and/or entrapped/entrained in/on the leading roller 424 as the surface cleaning head 400 is being used (e.g., without the user having to manually remove the debris from the leading roller 424). According to one embodiment, the debriding protrusions 450 may contact only the leading roller 424 (e.g., the debriding protrusions 450 may not contact the brush roll 422). Some of the benefits of the debriding protrusions 450 only contacting the leading roller 424 include increasing the lifespan of the leading roller 424. Additionally, the debriding protrusions 450 that only contact the leading roller 424 may reduce the load/drag on the motor, thereby allowing a smaller/less expensive motor to be used and making the surface cleaning head 400 lighter and less expensive to manufacture.

In this embodiment, the debriding protrusions 450 may include a plurality of spaced ribs 452 with angled edges 453 extending into contact with a surface of the leading roller 424. The spaced ribs 452 extend from a back support 451 with base portions 454 located therebetween to reinforce the spaced ribs 452. The back support 451 may be mounted within the leading roller chamber 458 The angled edges 453 of the spaced ribs 452 may be arranged at an angle A (see FIGS. 8 and 10) that is in the range of 15-20 degrees, for example, 20-25 degrees, such as 23.5 degrees. This example structure of the debriding protrusions 450 may allow for increased strength and reduced frictional loses since less points may contact the leading roller 424.

Figure 8:
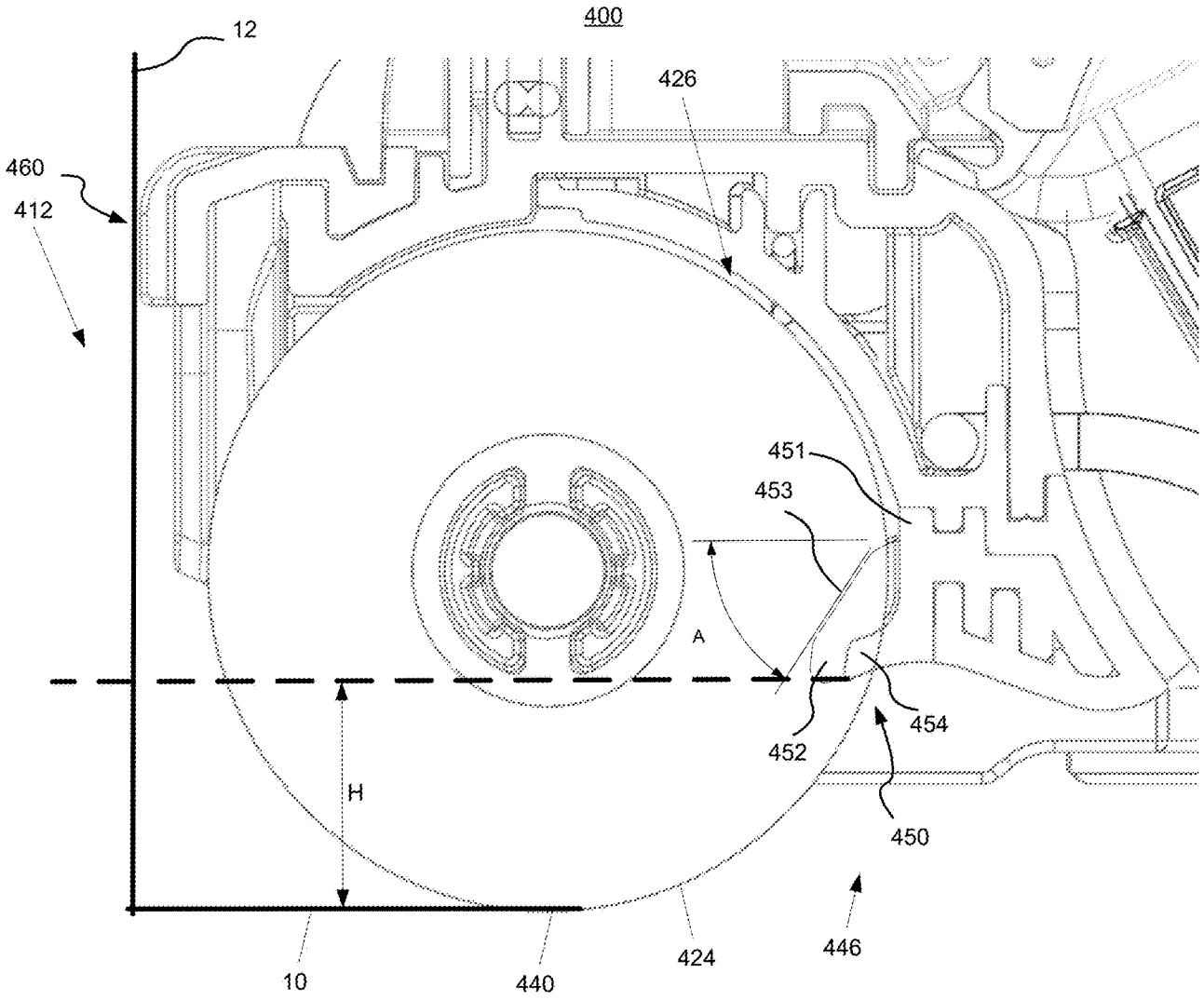
FIG. 8 is an enlarged side cross-sectional view illustrating a leading roller and debriding protrusions in the surface cleaning head shown in FIG. 4.
Figure 9:
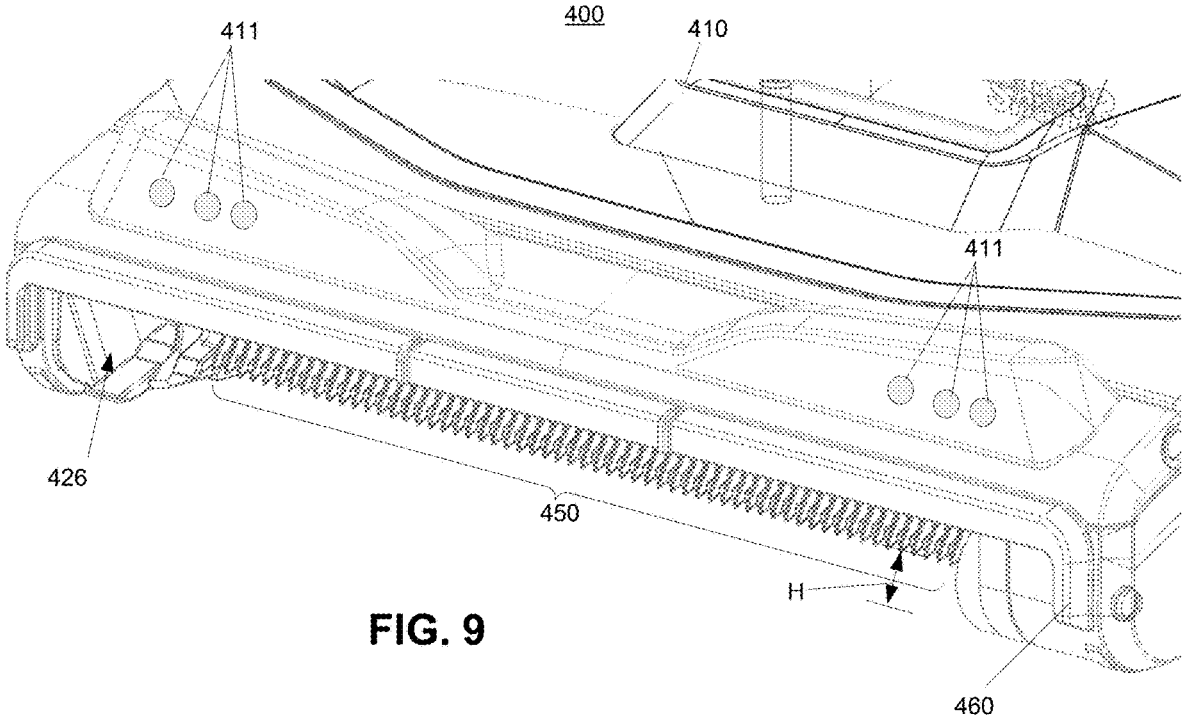
FIG. 9 is a front perspective view of the front region of the surface cleaning head of FIG. 4 without the leading roller and illustrating the debriding protrusions.
Figure 10:
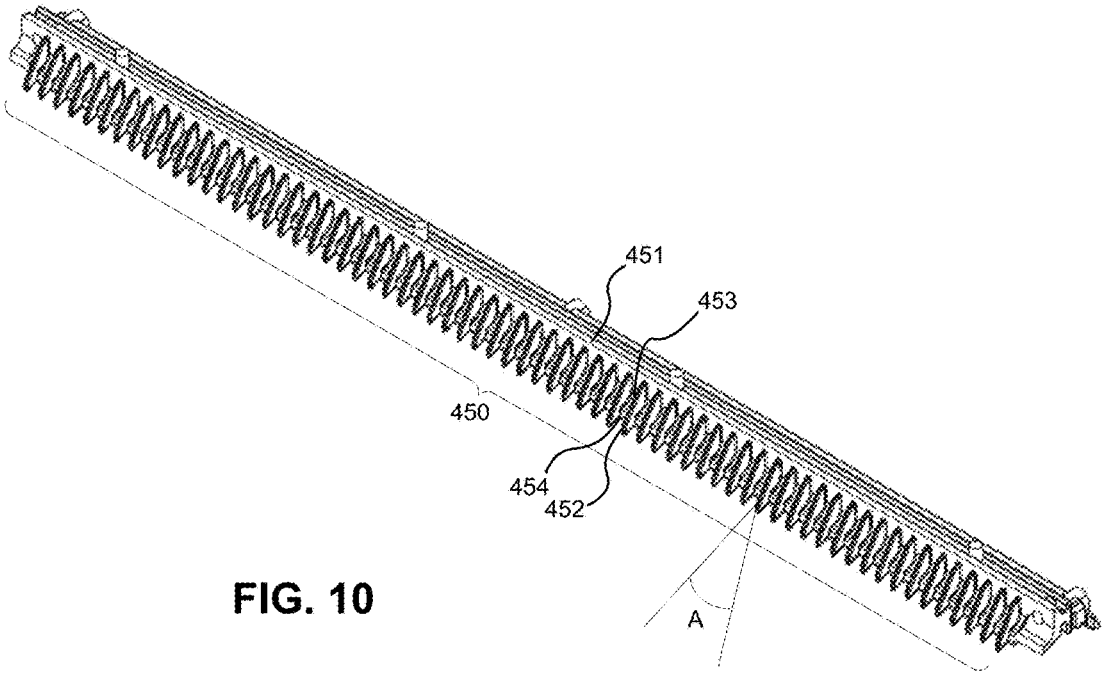
FIG. 10 is an enlarged perspective view of one embodiment of a plurality of debriding protrusions.

As shown in FIGS. 8 and 9, the debriding protrusions 450 may be disposed at a height H above the bottom contacting surface 440 of the leading roller 424 and on a side or lower half of the leading roller 424. The placement of the debriding protrusions 450 may help to prevent the debriding protrusions 450 from contacting a carpet, thereby reducing drag on the surface cleaning head 400 and reducing the likelihood of the debriding protrusions 450 damaging the carpet. This arrangement also allows the debriding protrusions 450 to be exposed to the inter-roller vacuum passageway 446, thereby enhancing the removal of debris from the leading roller 424 by the debriding protrusions 450. The debriding protrusion 450 may also substantially prevent air from flowing through the debriding protrusions 450 to the inside upper portion (e.g., upper half) of the leading roller 424.

Figure 11:
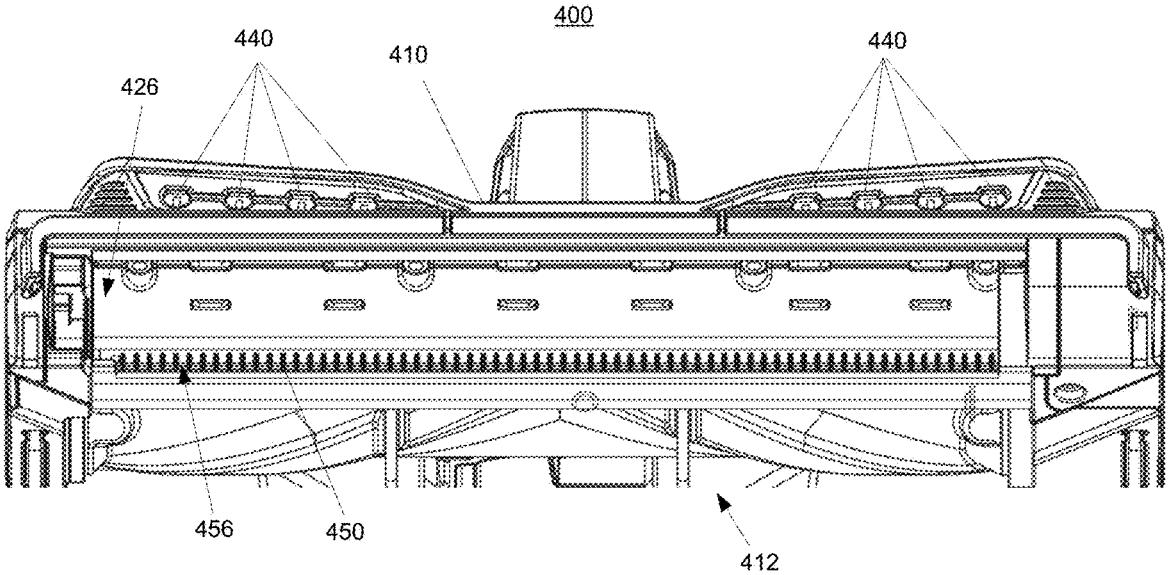
FIG. 11 is a front bottom view of the front region of the surface cleaning head of FIG. 4 without the leading roller.
Figure 12:
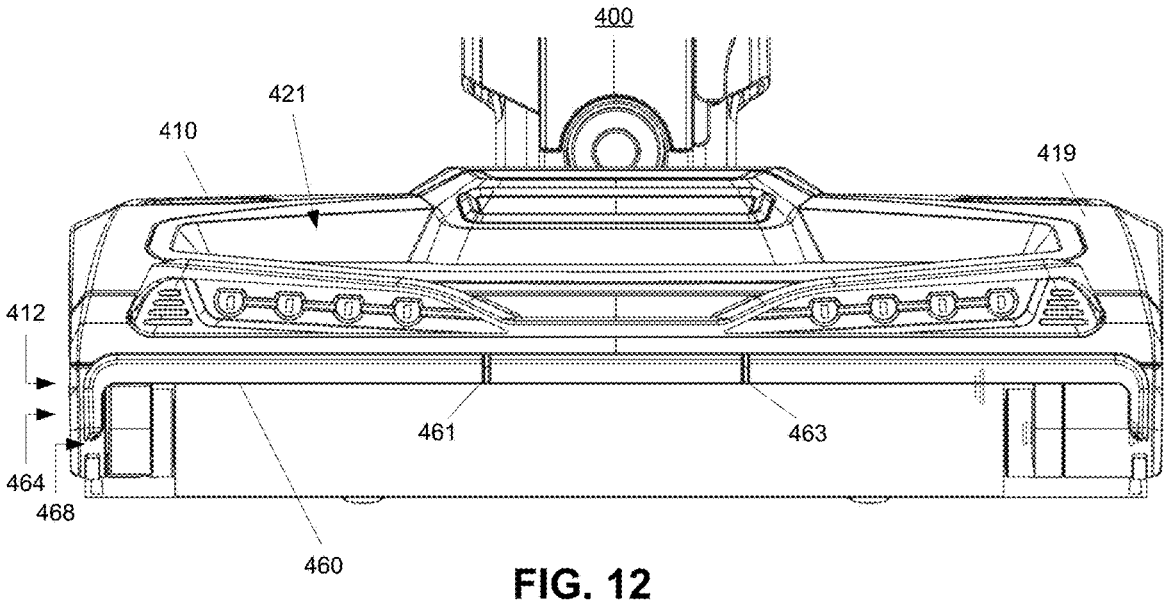
FIG. 12 is a front view the surface cleaning head of FIG. 4.

As shown in FIG. 11, an embodiment of the surface cleaning head 400 optionally includes an electrostatic discharge element (ESD) 456. The ESD 456 may reduce and/or prevent the buildup of electrostatic charge on the surface cleaning head 400. The ESD 456 may include any known device for discharging electrostatic charge. According to one embodiment, the ESD 456 may include Barnet fibers woven between the openings in the back of the leading roller chamber 426. The Barnet fibers may be arranged in close proximity to the debriding protrusions 450 and/or leading roller 424 for discharging. For example, the ESD 456 may be connected to a printed circuit board assembly (PCBA) that dumps charge out to the neutral AC line.

In some embodiments, the housing 410 may further include a bumper 460 forming a top part of the front side 412 of the housing 410, as shown in FIGS. 4, 6, 8, and 12. The bumper 460 may reduce potential damage to either the surface cleaning head 400 and/or other objects in the environment. A front portion of the leading roller 424 is exposed at the front side 412 of the housing 410, and the bumper 460 may extend around at least a top of the leading roller 424. In the example, embodiment the bumper 460 includes a lateral portion 462 extending laterally along the front side 412 of the housing 410 and side portions 464, 468 extending downwardly along left and right sides of the front side 412 of the housing 410. The side portions 464, 468 may extend to a point at or below the second rotation axis RA2 of the leading roller 424.

The bumper 460 may optionally define one or more front edge vacuum passageways 468, 469 providing at least a portion of the air flow path. The bumper 460 may therefore generally form a seal with a vertical surface 12 (e.g., wall or the like) to improve front edge cleaning. The front edge vacuum passageways 468, 469 may allow for increased airspeed of the air being sucked into the surface cleaning head 400, thereby enhancing front edge cleaning. The bumper 460 may also include one or more lateral air passageways disposed in the lateral portion 462, which also allow for increased airflow along the front side 412.

The bumper 460 may also include one or more compression elements 461, 463 disposed on the lateral edge/section 462. The compression elements 461, 463 allow for increased resiliency and cushioning of the bumper 460. The bumper 160 may be formed as one piece with the housing 410 or may be formed as a separate piece secured within a groove and/or notch 465 formed between two or more pieces (e.g., an upper and lower portion 410*a*, 410*b*) of the housing 410, as shown in FIG. 6. The groove and/or notch 465 may facilitate assembly of the housing 410 and the bumper 460 (e.g., between a headlight portion 410*a* and main portion 410*b* of the housing 410).

Figure 4:
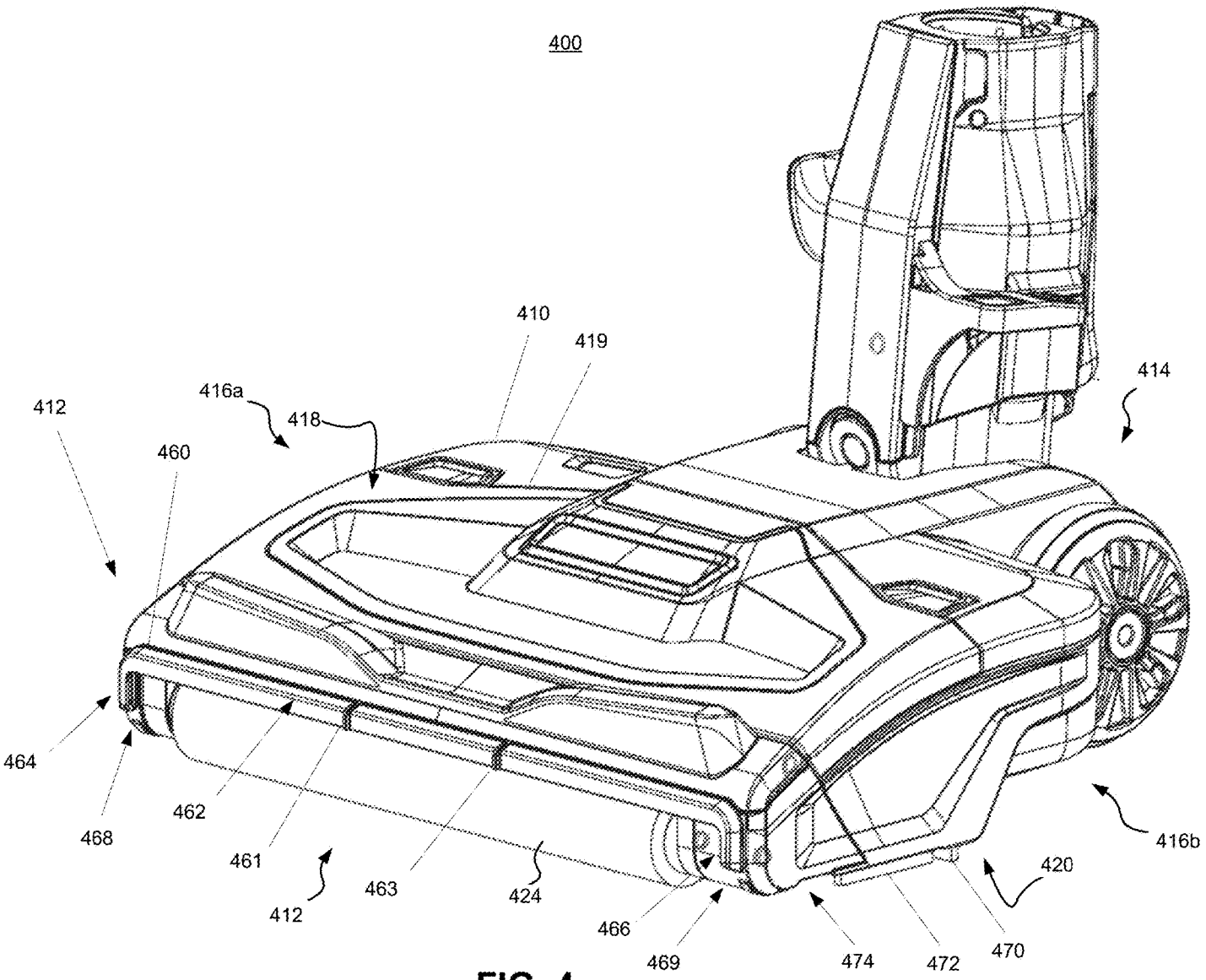
FIG. 4 is a perspective view of a surface cleaning head including dual agitators, consistent with another embodiment of the present disclosure.
Figure 13:
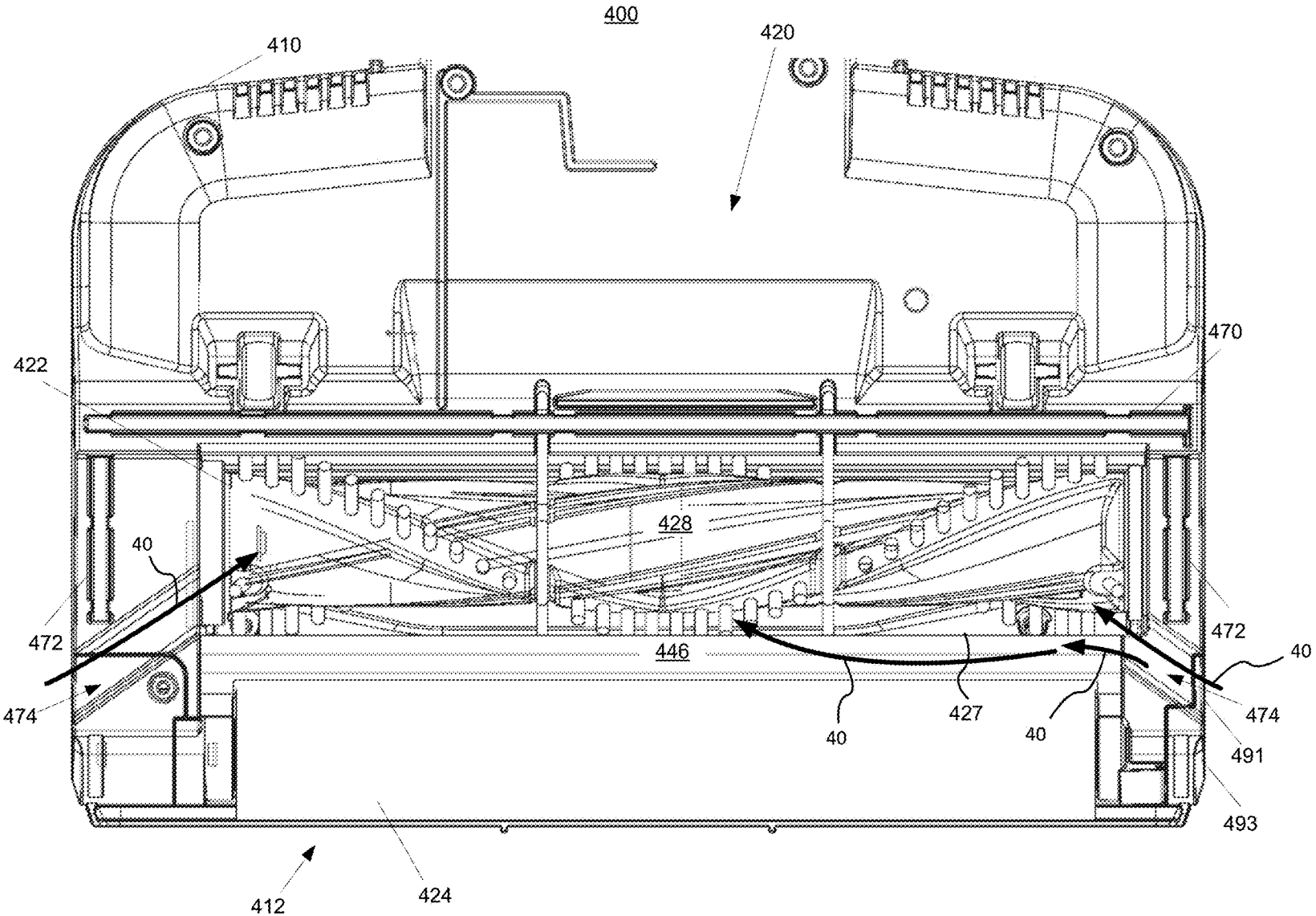
FIG. 13 is a bottom view the surface cleaning head of FIG. 4.
Figure 14A:
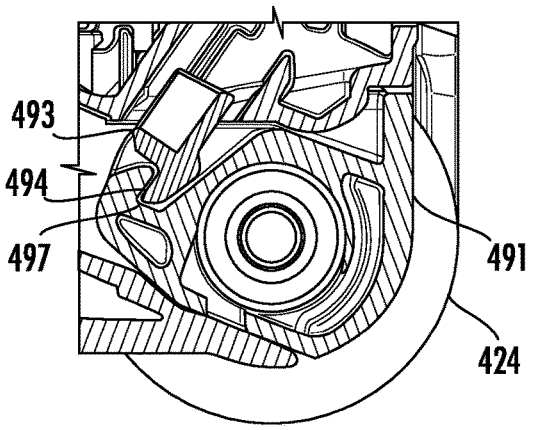
FIGS. 14A-14D are cross-sectional views of one embodiment of a leading roller release mechanism used in the surface cleaning head shown in FIG. 4.
Figure 14B:
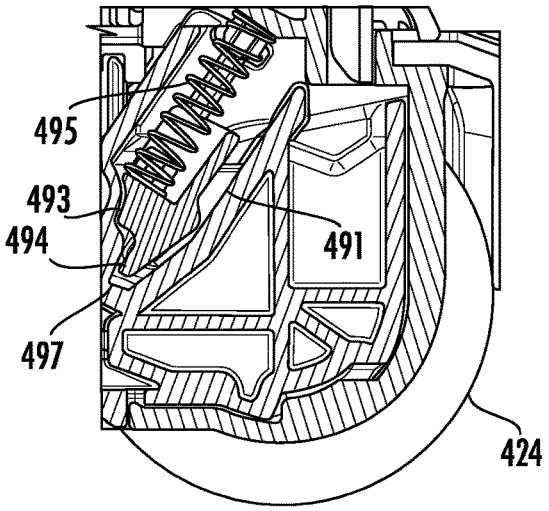
Figure 14C:
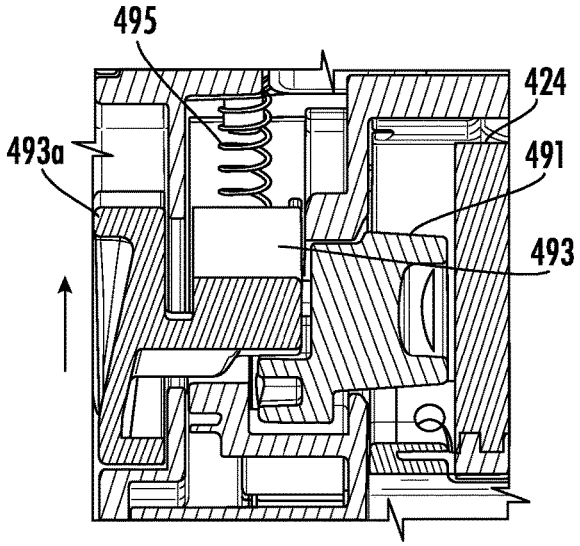
Figure 14D:
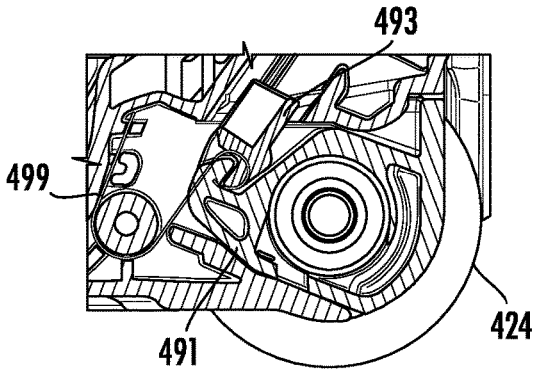
Figure 15:
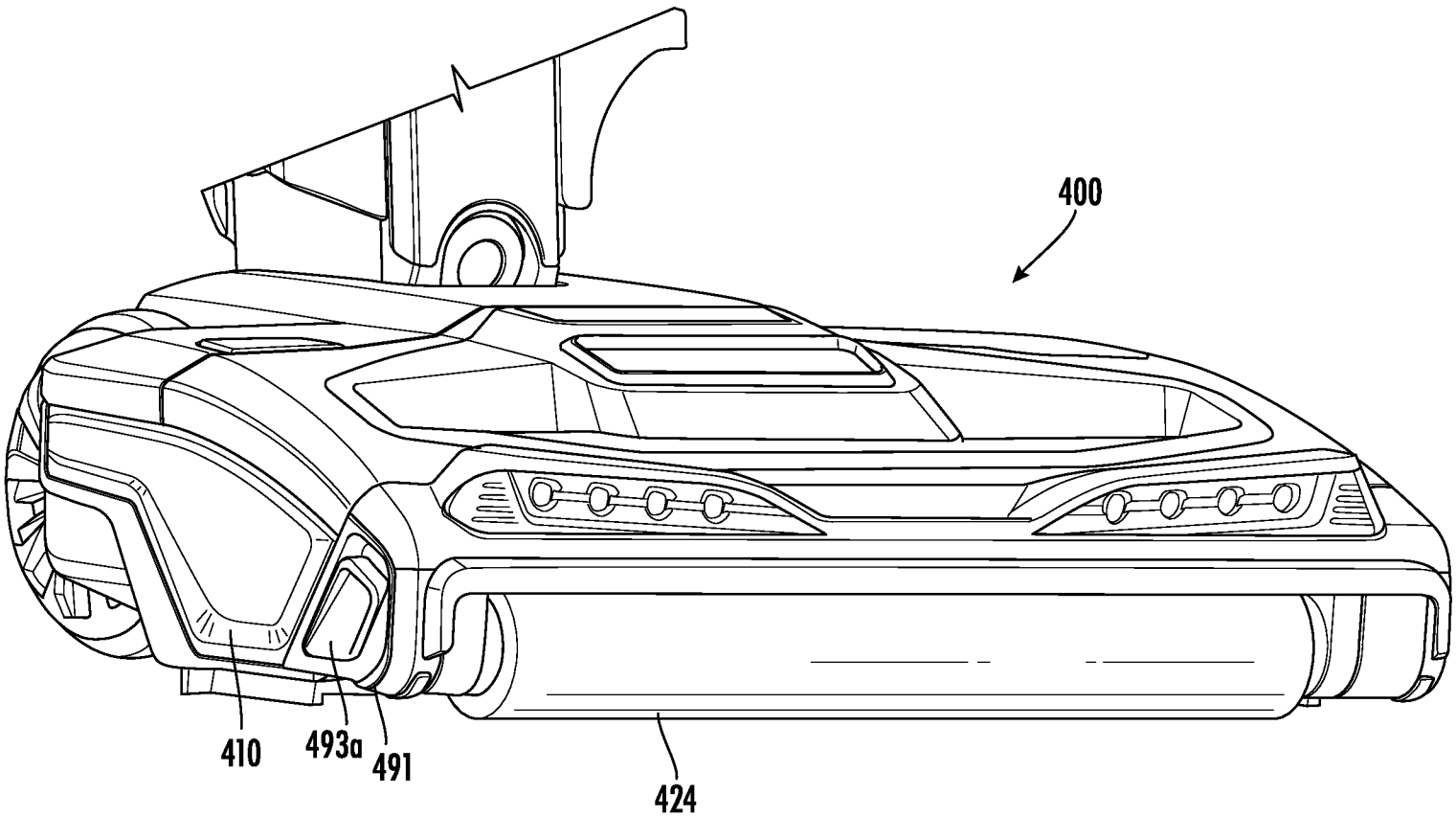
FIG. 15 is a perspective view of another side of the surface cleaning head shown in FIG. 4 showing the roller release mechanism.

In some embodiments, the surface cleaning head 400 may further include one or more floor sealing strips 470, 472 and side edge vacuum passageways 474 on an underside of the housing 410, as shown in FIGS. 4 and 13. The floor sealing strip(s) 470, 472 may include one or more sections extending outwardly from the housing 410 and having a length sufficient to at least partially contact the surface 10 to be cleaned. The floor seals strip(s) 470, 472 may include soft bristles, fabric material, rubber material, or other material capable of contacting the surface being cleaned to substantially prevent air flow into the opening 432 from the rear side. The sealing strips 470, 472 may also include a combination of elements or materials, such as bristles with a rubber strip extending along the strip between the bristles (e.g., with the bristles being longer than the rubber strip).

In the example embodiment, a lateral floor sealing strip 470 extends along a rear lateral portion (e.g., behind the opening 427 of the suction conduit 428) and side sealing strips 472 extend partially along the left and right sides 416*a*, 416*b*. The side sealing strips 472 extend, for example, along a substantial portion of the opening 427 of the suction conduit 428 and are spaced from the leading roller 424 to define one or more side edge vacuum passageways 474 extending back towards the opening 427 of the suction conduit 428. Because the leading roller 424 itself forms a seal with the surface 10 being cleaned, additional sealing strips are unnecessary along the front side 412. Although separate strips 470, 472 are shown, one continuous sealing strip may be used. The floor sealing strips 470, 472 may enhance sealing between the surface cleaning head 400 and the floor 10, thereby enhancing the vacuum efficiency.

The side edge vacuum passageways 474 may enhance the side edge cleaning efficiency of the surface cleaning head 400. Side edge vacuum passageways 474 draw in air from the front 412 and the corner/sides 416*a*, 416*b* towards the suction conduit 428, thereby enhancing edge cleaning as well as front cleaning. The side edge vacuum passageways 474 may also direct air into the inter-roller air passageway 446 between the leading roller 424 and the brush roll 422 to facilitate removal of debris from the leading roller 424. As such, the side edge vacuum passageways 474 and the inter-roller air passageway 446 together provide at least a portion of the air flow path (e.g., as indicated by arrows 40) into the suction conduit 428.

The side edge vacuum passageways 474 may be arranged at an approximately 45 degree angle with respect the longitudinal axis of the housing 410. In other embodiments, the angle of the side edge vacuum passageways 474 may be within 30 to 60 degrees with respect the longitudinal axis of the housing 410. Although the side edge passageways are shown as angled straight passageways, other shapes and configurations (e.g., S shaped or curved) are also possible and within the scope of the present disclosure.

Referring to FIGS. 14A-14D and 15, one embodiment of a roller release mechanism for releasing the leading roller 424 from the housing 410 of the surface cleaning head 400 is described in greater detail. In this embodiment, the leading roller 424 is rotatably coupled to a removable panel 491 that is secured in place by way of a biased tab 493. The biased tab 493 has a user accessible portion 493*a* located on a side of the housing 410. The biased tab 493 is urged against (e.g., into mechanical engagement with) the removable panel 491 using one or more springs 495 or the like. In particular, the spring 495 urges the finger 494 of the biased tab 493 into mechanical engagement with a notch 497 of the removable panel 491.

To remove the leading roller 424, the user may apply a force (e.g., generally in the direction of arrow B in FIG. 17) to the user accessible portion 493*a* to urge the tab 493 against the spring 495, thereby disengaging the finger 494 from the notch 497 of the panel 491. An ejector spring 499 (or the like) may then urge the removal panel 491 out of mechanical engagement with housing 410, thereby allowing the leading roller 424 to be removed from the chamber 454. It should be appreciated, however, that this is just one embodiment and that the leading roller 424 may be removably coupled in any manner known to those skilled in the art in view of the present disclosure.

Figure 16:
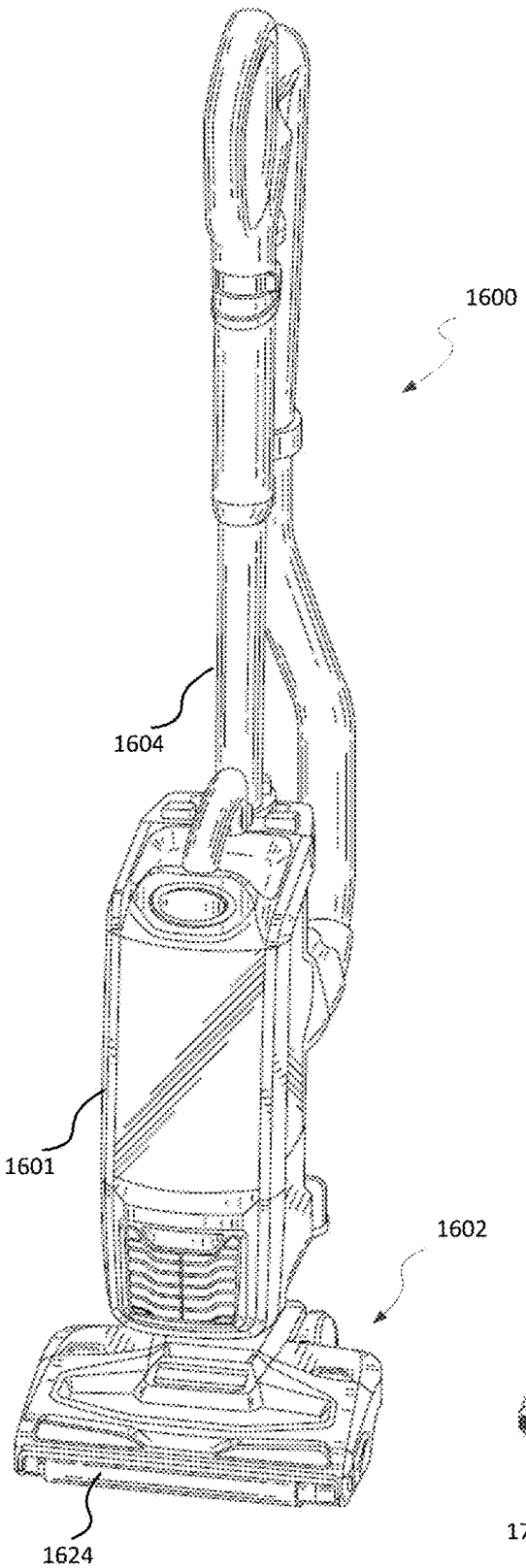
FIG. 16 is a perspective view of an upright vacuum cleaner including a surface cleaning head with dual rotating agitators, consistent with embodiments of the present disclosure.
Figure 17:
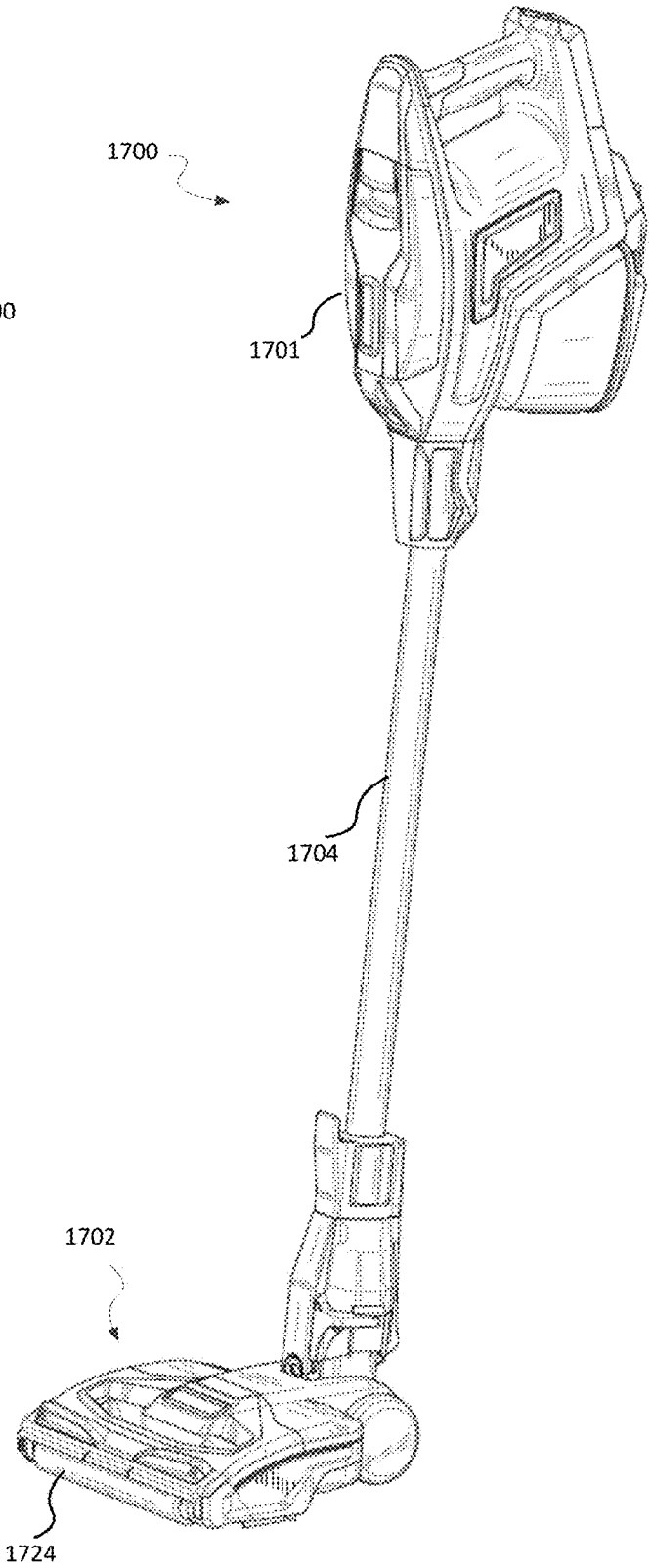
FIG. 17 is a perspective view of a stick type vacuum cleaner including a surface cleaning head with dual rotating agitators, consistent with embodiments of the present disclosure.

FIGS. 16 and 17 illustrate examples of two different types of vacuum cleaners 1600, 1700 that may include a surface cleaning head 1602, 1702 with dual agitators including a leading roller 1624, 1724, consistent with the embodiments described herein. The surface cleaning head 1602 with the leading roller 1624 may be used on an upright vacuum cleaner 1600 with a removable canister 1601 coupled to a wand 1604, such as the type described in U.S. Patent Application Pub. No. 2015/0351596, which is commonly owned and fully incorporated herein by reference. The surface cleaning head 1702 with the leading roller 1724 may be used on a stick type vacuum cleaner 1700 with a removable handheld vacuum 1701 coupled at one end of a wand 1704, such as the type described in U.S. Patent Application Pub. No. 2015/0135474, which is commonly owned and fully incorporated herein by reference.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A surface cleaning head comprising:

a housing having a front side and back side, the housing including a suction conduit with an opening on an underside of the housing between the front side and the back side;

a brush roll rotatably mounted to the housing within the suction conduit and at least a portion of the brush roll being proximate the opening of the suction conduit, the brush roll having a plurality of bristles;

a leading roller mounted to the housing at least partially in a leading roller chamber such that the leading roller is located in front of the brush roll and spaced from the brush roll such that the leading roller and the brush roll do not overlap when both the brush roll and the leading roller are driven and define an inter-roller air passageway, the inter-roller air passageway forming at least a portion of a flow path into the opening of the suction conduit in a region between a lower portion of the brush roll and a lower portion of the leading roller, wherein at least an inside of the lower portion of the leading roller is exposed to the flow path flowing through the inter-roller air passageway to the suction conduit and wherein at least an inside of an upper portion of the leading roller is substantially outside of the flow path to the suction conduit, wherein the leading roller has a diameter Dlr in the range of 0.3Dbr to 0.8Dbr, wherein Dbr is the diameter of the brush roll, and wherein a position of a rotation axis of the leading roller is fixed relative to a rotation axis of the brush roll and the leading roller including fabric, felt, nap or pile that is softer than the plurality of bristles of the brush roll;

debriding protrusions extending from a wall at least partially separating the leading roller chamber and the suction conduit, the debriding protrusions including angled edges angled downward to contact an outer surface of the lower portion of the leading roller to remove debris from the leading roller, the debriding protrusions exposed to the inter-roller passageway such that the removed debris falls into the inter-roller passageway and into the flow path to the opening of the suction conduit; and a drive mechanism operatively coupled to the brush roll and the leading roller for driving the brush roll and the leading roller at the same time.

2. The surface cleaning head of claim 1, wherein a bottom contact surface of the leading roller is located below a bottom contact surface of the brush roll.

3. The surface cleaning head of claim 1, wherein the drive mechanism is operatively coupled to the brush roll and the leading roller for driving and rotating the brush roll and the leading roller in same direction at same time.

4. The surface cleaning head of claim 1, wherein the leading roller is removable from the housing.

5. The surface cleaning head of claim 1, wherein the housing includes at least one cover covering at least one of a brush roll chamber and a leading roller chamber, wherein at least one of the brush roll and the leading roller is removable when the cover is in an open position.

6. The surface cleaning head of claim 1, further comprising a bumper on a front side of the housing providing a leading edge in front of the leading roller.

7. The surface cleaning head of claim 1, further comprising at least one light source disposed on the front side of the housing generally above the leading roller.

8. A stick vacuum comprising:

a surface cleaning head as recited in claim 1;

a wand coupled at one end to the surface cleaning head; and a hand vacuum removably coupled to an opposite end of the wand.

9. An upright canister vacuum comprising:

a surface cleaning head as recited in claim 1;

a wand coupled at one end to the surface cleaning head; and a removable canister coupled to the wand.

10. The surface cleaning head of claim 1, wherein contact between the leading roller and the debriding protrusions substantially prevents air flow to the inside of the upper portion of the leading roller such that the inside of the upper portion of the leading roller is substantially outside of the flow path to the suction conduit.

11. A surface cleaning head comprising:

a housing having a front side and back side, the housing including a suction conduit with an opening on an underside of the housing between the front side and the back side;

a brush roll rotatably mounted to the housing within the suction conduit and at least a portion of the brush roll being proximate the opening of the suction conduit, the brush roll having a plurality of bristles;

a leading roller mounted to the housing at least partially in a leading roller chamber such that the leading roller is located in front of the brush roll and spaced from the brush roll to define an inter-roller air passageway, the inter-roller air passageway forming at least a portion of a flow path into the opening of the suction conduit in a region between a lower portion of the brush roll and a lower portion of the leading roller, wherein at least an inside of the lower portion of the leading roller is exposed to the flow path flowing through the inter-roller air passageway to the suction conduit, the leading roller having a diameter Dlr in the range of 0.3Dbr to 0.8Dbr, wherein Dbr is the diameter of the brush roll, and wherein a position of a rotation axis of the leading roller is fixed relative to a rotation axis of the brush roll and the leading roller including fabric, felt, nap or pile that is softer than the plurality of bristles of the brush roll;

debriding protrusions extending from a wall at least partially disposed between the leading roller chamber and the brush roll in the suction conduit, the debriding protrusions including angled edges angled downward to contact an outer surface of the lower portion of the leading roller to remove debris from the leading roller and cause the debris to fall into the inter-roller passageway and into the flow path to the opening of the suction conduit, the debriding protrusions being exposed to the inter-roller passageway such that the inside of the upper portion of the leading roller is substantially outside of the flow path to the suction conduit; and a drive mechanism operatively coupled to the brush roll and the leading roller for rotating the brush roll and the leading roller at the same time.

12. A surface cleaning head comprising:

a housing having a front side and back side, the housing including a suction conduit with an opening on an underside of the housing between the front side and the back side and a leading roller chamber at least partially separated from the suction conduit by a wall;

a brush roll rotatably mounted to the housing within the suction conduit and at least a portion of the brush roll being proximate the opening of the suction conduit, the brush roll having a plurality of bristles;

a leading roller mounted at least partially in the leading roller chamber such that the leading roller is located in front of and spaced from the brush roll and adjacent to the opening of the suction conduit, wherein the leading roller has a diameter Dlr in the range of 0.3Dbr to 0.8Dbr, wherein Dbr is the diameter of the brush roll, and wherein a position of a rotation axis of the leading roller is fixed relative to a rotation axis of the brush roll and the leading roller including fabric, felt, nap or pile that is softer than the plurality of bristles of the brush roll; and a series of spaced debriding protrusions extending from the wall and including angled edges contacting an outer surface of a lower portion of the leading roller without contacting the brush roll, wherein at least the angled edges are angled downward;

an inter-roller air passageway between a lower portion of the brush roll and the lower portion of the leading roller and below the debriding protrusions, the inter-roller air passageway being in fluid communication with the suction conduit, wherein an upper portion of the leading roller above the debriding protrusions is outside of the suction conduit; and a drive mechanism operatively coupled to the brush roll and the leading roller for rotating the brush roll and the leading roller at the same time.

* * * * *